US009685726B2

(12) United States Patent
Ang et al.

(10) Patent No.: US 9,685,726 B2
(45) Date of Patent: Jun. 20, 2017

(54) TERMINAL AND CONNECTOR ASSEMBLY

(71) Applicant: Molex, LLC, Lisle, IL (US)

(72) Inventors: Lay Khim Ang, Singapore (SG); Kian Heng Lim, Singapore (SG); Siow Pheng Goh, Singapore (SG)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/073,748

(22) Filed: Mar. 18, 2016

(65) Prior Publication Data

US 2017/0025778 A1 Jan. 26, 2017

(30) Foreign Application Priority Data

Mar. 19, 2015 (CN) ..... 2015 1 0122325
Mar. 19, 2015 (CN) ..... 2015 2 0158566 U
Oct. 12, 2015 (CN) ..... 2015 1 0659101
Oct. 12, 2015 (CN) ..... 2015 2 0790055 U

(51) Int. Cl.
*H01R 13/28* (2006.01)
*H01R 13/422* (2006.01)
*H01R 13/05* (2006.01)
*H01R 13/627* (2006.01)

(52) U.S. Cl.
CPC ..... *H01R 13/4223* (2013.01); *H01R 13/05* (2013.01); *H01R 13/6272* (2013.01)

(58) Field of Classification Search
CPC ..... H01R 13/05; H01R 13/28; H01R 13/052; H01R 13/20; H01R 23/27
USPC ..... 439/825, 295
See application file for complete search history.

(56) References Cited

U.S. PATENT DOCUMENTS 3,189,868 A * 6/1965 Hatfield ..... H01R 13/20 439/825
3,827,007 A * 7/1974 Fairbairn ..... H01R 13/28 439/293
4,169,654 A * 10/1979 Plyler ..... H01R 13/052 439/825

(Continued)

FOREIGN PATENT DOCUMENTS

GB 886251 1/1962

*Primary Examiner* — Gary Paumen
(74) *Attorney, Agent, or Firm* — James A. O'Malley

(57) ABSTRACT

The present disclosure provides a conductive terminal and an electrical connector assembly. The conductive terminal comprises: a base unit, a contacting unit, a connecting piece and a tail unit. The connecting piece connects the base unit and the contacting unit. The base unit comprises a plate portion extending along a front-rear direction. The contacting unit faces the plate portion, is spaced apart from the plate portion and comprises a plate-shaped contacting portion and an elastic contacting portion positioned behind the plate-shaped contacting portion. The tail unit is connected to a rear end of the plate portion. In the electrical connector assembly, in every two mated conductive terminals between the first connector and the second connector, the elastic contacting portion of one conductive terminal contacts the plate-shaped contacting portion of the other conductive terminal and the elastic contacting portion of the other conductive terminal contacts the plate-shaped contacting portion of the one conductive terminal, so that two contacting regions are formed between the every two mated conductive terminal.

39 Claims, 43 Drawing Sheets

(56) References Cited

U.S. PATENT DOCUMENTS

| | | | | | |
|---|---|---|---|---|---|
| 4,764,129 | A | | 8/1988 | Jones et al. | |
| 4,963,102 | A | * | 10/1990 | Gettig | H01R 13/28 439/291 |
| 5,181,855 | A | * | 1/1993 | Mosquera | H01R 13/28 439/291 |
| 5,209,680 | A | * | 5/1993 | Fry | H01R 13/05 439/825 |
| 5,791,923 | A | * | 8/1998 | Picaud | H01R 13/05 439/188 |
| 8,961,230 | B2 | | 2/2015 | Chou | |
| 2012/0057824 | A1 | | 3/2012 | Katoh | |

* cited by examiner

TERMINAL AND CONNECTOR ASSEMBLY

RELATED APPLICATIONS

This application claims the benefit of Chinese Patent Application No. 201510122325.1 filed on Mar. 19, 2015; Chinese Utility Model Application No. 201520158566.7 filed on Mar. 19, 2015; Chinese Patent Application No. 201510659101.4 filed on Oct. 12, 2015; and Chinese Utility Model Application No. 201520790055.7 filed on Oct. 12, 2015, all of which are incorporated herein by reference in their entirety.

FIELD OF THE DISCLOSURE

The present disclosure relates to a conductive terminal and an electrical connector assembly, and more specifically relates to a conductive terminal and an electrical connector assembly in which the two conductive terminals may be mated with each other to form two contacting regions.

DESCRIPTION OF RELATED ART

In a known matable male connector and female connector assembly, a conductive terminal provided in a male connector and a conductive terminal provided in a female connector each have a contact elastic piece and each are used to connect a cable. When the male connector and the female connector are mated with each other, the conductive terminal of the male connector and the conductive terminal of the female connector contact with each other via the two contact elastic pieces, there is only one contact region between the two mated conductive terminals, but both of the two contact elastic pieces of the two conductive terminal have elasticity, therefore the two contact elastic pieces are easily affected by an improper external force, such as vibration, pulling from the cable and the like, the two contact elastic pieces of the two conductive terminals cannot stably contact with each other. Moreover, after long-term use, the contact elastic piece may generate elastic fatigue, which also easily results in the contact between the two contact elastic pieces of the two conductive terminals not stable.

BRIEF SUMMARY

An electrical connector assembly of the present disclosure includes a first connector and a second connector mated with the first connector. A first connector having a first insulating housing and a plurality of conductive terminals provided in the first insulating housing is configured to connect with a second connector also having a second insulating housing and a plurality of conductive terminals provided in the second insulating housing.

The connector includes a conductive terminal having a base unit, a contacting unit, a connecting piece and a tail unit. The connecting piece connects the base unit and the contacting unit. The base unit includes a plate portion extending along a front-rear direction. The base unit further includes two wing portions extending respectively from two sides of the front end of the plate portion toward two opposite directions, and the two wing portions are respectively positioned in front of the two side plate portions and received in corresponding slots in the housing. The contacting unit faces the plate portion, is spaced apart from the plate portion and comprises a plate-shaped contacting portion and an elastic contacting portion positioned behind the plate-shaped contacting portion.

The tail unit is connected to a rear end of the plate portion with a positioning portion connected to the plate portion, a conductor fixing portion connected to the positioning portion and used to clamp and fix a part of a conductor of a cable without a corresponding insulating covering and an insulating covering fixing portion connected to the conductor fixing portion and used to clamp and fix a part of the cable with the corresponding insulating covering. A latching portion formed by separating a part of the plate portion, the latching portion extends rearwardly along the front-rear direction and extends obliquely toward a direction away from the plate body that engages a step portion formed in a cavity of the housing therefore securing the terminal to the housing. A positioning portion is formed from the base of the terminal having a profile that engages a similar profile formed in the cavity. A terminal holding member is secured to the housing from a rearward end and includes a positioning plate portion that engages the positioning portion of the terminal and securing the terminal within the cavity.

The plurality of conductive terminals of the first connector are used to respectively mate with the plurality of conductive terminals of the second connector, and in every two mated conductive terminals between the first connector and the second connector, the elastic contacting portion of one conductive terminal contacts the plate-shaped contacting portion of the other conductive terminal and the elastic contacting portion of the other conductive terminal contacts the plate-shaped contacting portion of the one conductive terminal, so that two contacting regions are formed between the every two mated conductive terminal.

The present disclosure at least has the following effect: the conductive terminal of the first connector and the conductive terminal of the second connector are identical in structure and dimension, manufacturing cost may be saved.

BRIEF DESCRIPTION OF THE DRAWINGS

The other features and effects of the present disclosure will be apparent through detailed description of embodiments with referring to the Figures, and in which:

FIG. 44 is a cross sectional view taken along a line MXXI-MXXI of FIG. 42;

DETAILED DESCRIPTION OF THE PREFERRED EMBODIMENTS

Figure 1:
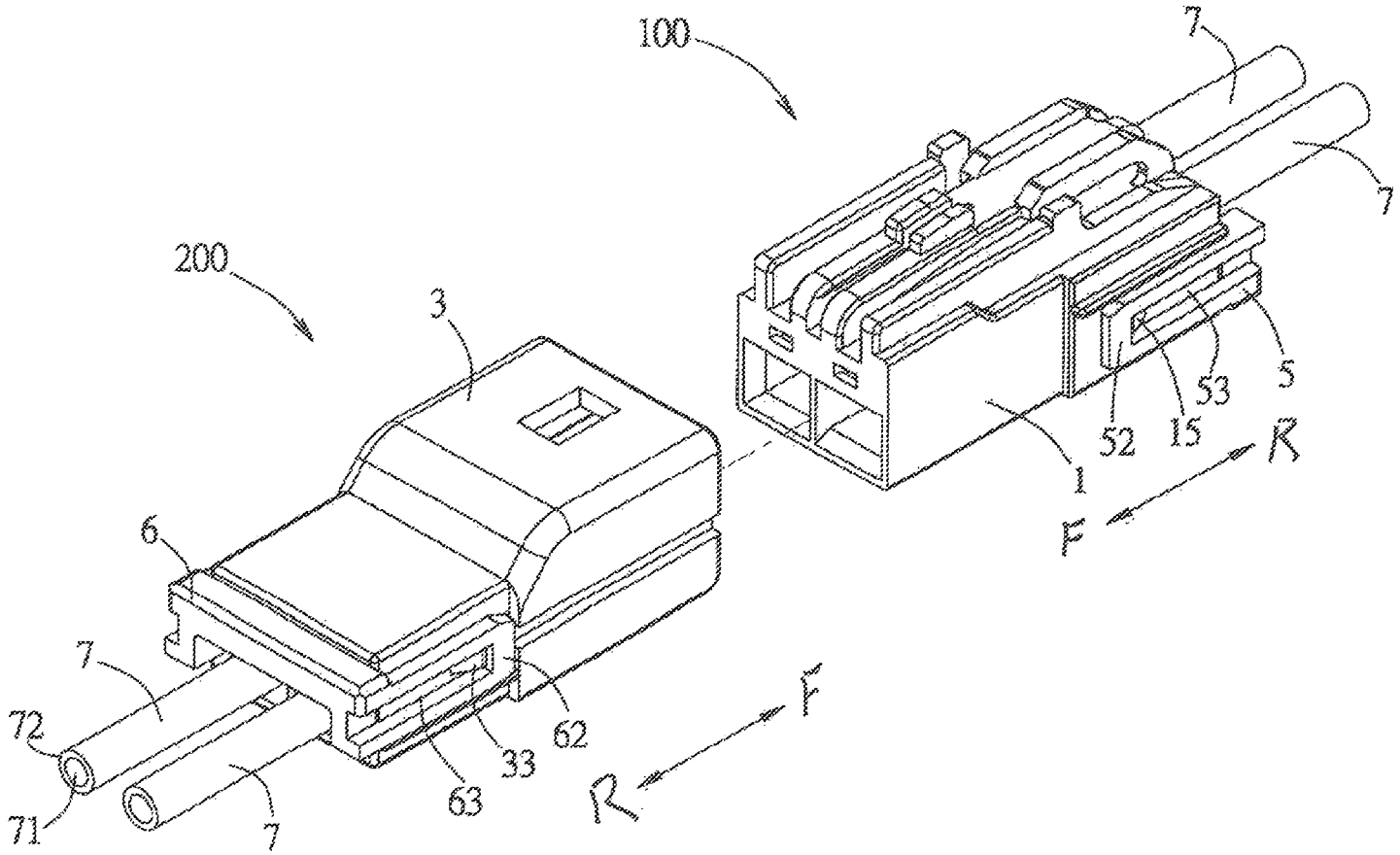
FIG. 1 is an exploded perspective view illustrating an embodiment of an electrical connector assembly of the present disclosure with a first connector and a second connector unmated with each other.

Before the present disclosure is described in detail, it should be noted that similar element is indicated by the same reference numeral in the following description.

Figure 2:
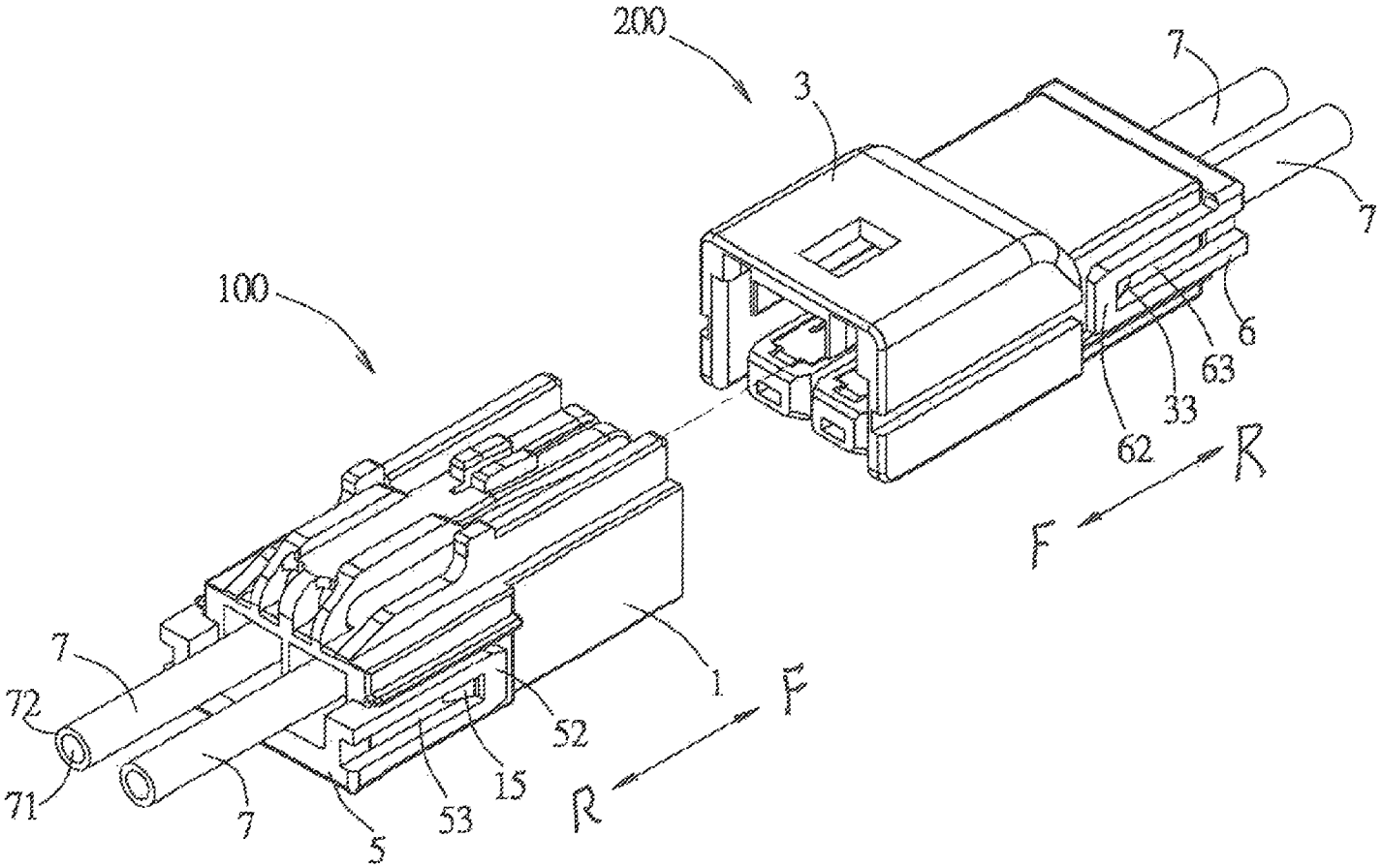
FIG. 2 is a view of FIG. 1 viewed from another angle.
Figure 3:
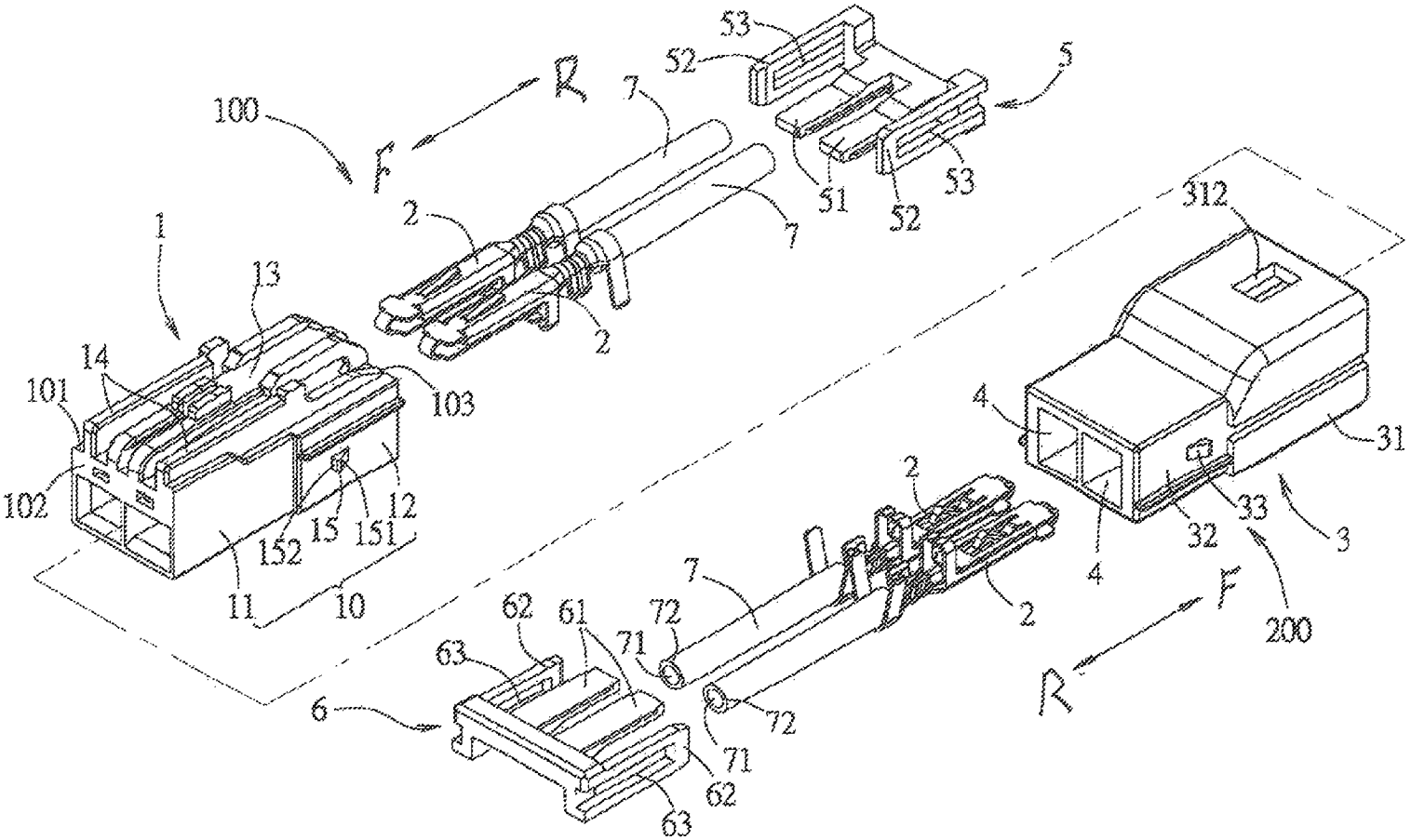
FIG. 3 is an exploded perspective view illustrating components of the first connector and the second connector of the embodiment.
Figure 4:
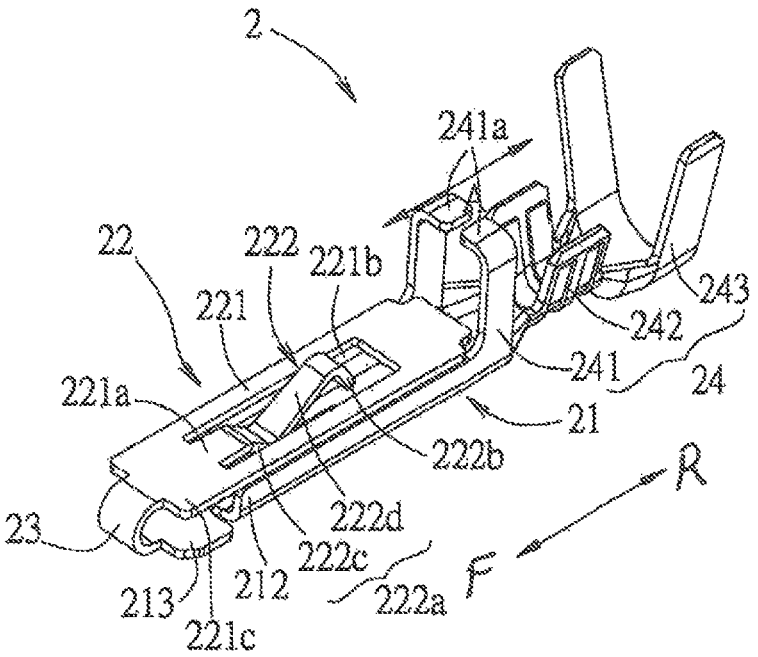
FIG. 4 is a perspective view illustrating a conductive terminal of the embodiment.
Figure 5:
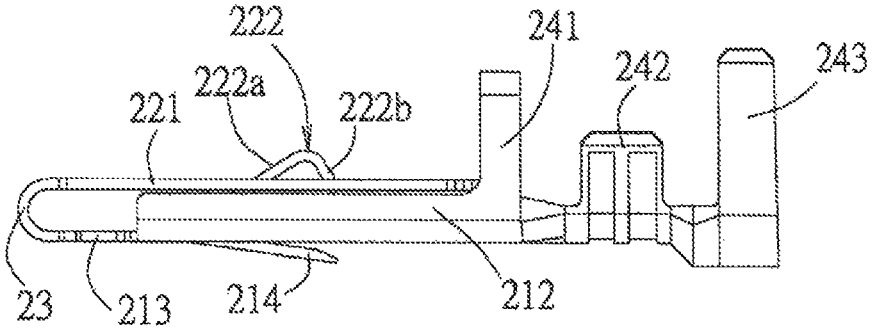
FIG. 5 is a side view illustrating the conductive terminal of the embodiment.
Figure 6:
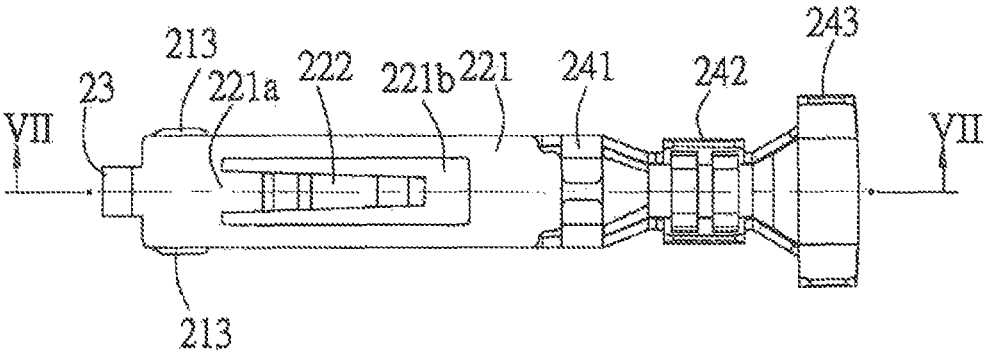
FIG. 6 is a top view illustrating the conductive terminal of the embodiment.
Figure 7:
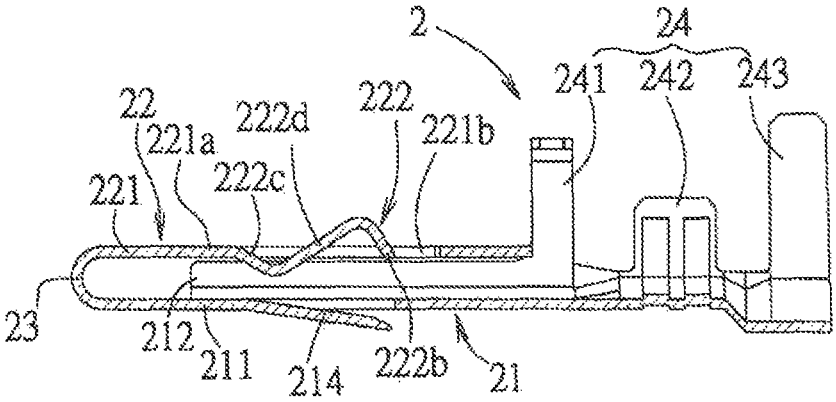
FIG. 7 is a cross sectional view taken along a line VII-VII of FIG. 6 and illustrating the conductive terminal of the embodiment.
Figure 8:
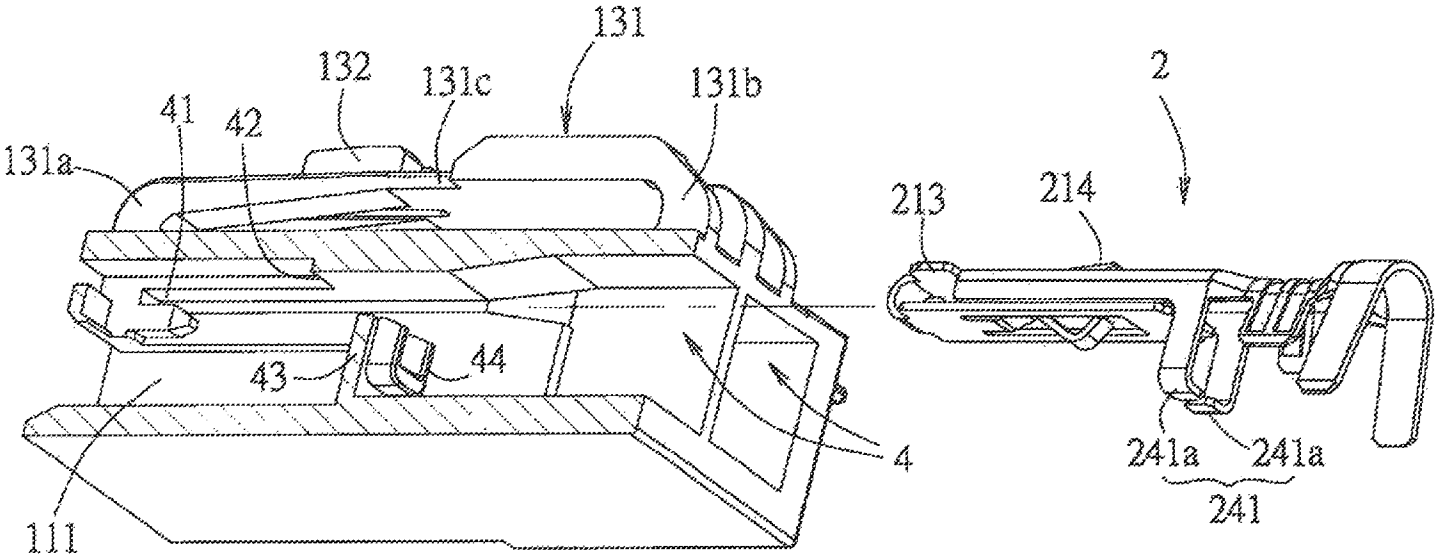
FIG. 8 is an exploded perspective view partially sectioned and illustrating a corresponding relationship between a terminal groove and the conductive terminal of the first connector of the embodiment in structure.
Figure 9:
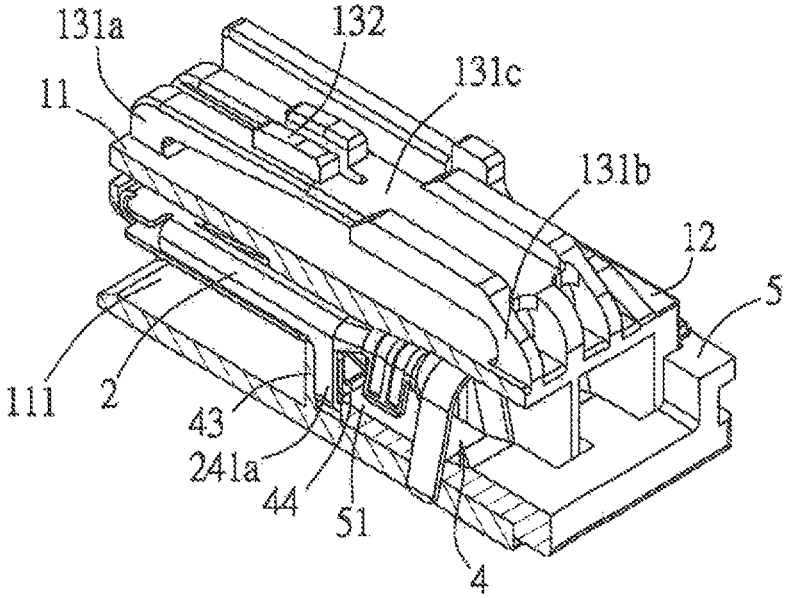
FIG. 9 is a perspective view partially sectioned and illustrating that the conductive terminal of the first connector of the embodiment is provided in the terminal groove and illustrating a functional relationship among the terminal groove, the conductive terminal and a first terminal holding member.

Referring to FIG. 1 to FIG. 3, an embodiment of an electrical connector assembly of the present disclosure comprises: a first connector 100 and a second connector 200 which may be mated with the first connector 100. The first connector 100 comprises a first insulating housing 1, a plurality of conductive terminals 2 provided in the first insulating housing 1 and a first terminal holding member 5. The second connector 200 comprises a second insulating housing 3, a plurality of conductive terminals 2 provided in the second insulating housing 3 and a second terminal holding member 6. In the embodiment, the conductive terminal 2 of the first connector 100 and the conductive terminal 2 of the second connector 200 are identical.

Referring to FIG. 4 to FIG. 7, each conductive terminal 2 of the first connector 100 and the second connector 200 comprises a base unit 21, a contacting unit 22, a connecting piece 23 and a tail unit 24. The connecting piece 23 connects the base unit 21 and the contacting unit 22. The base unit 21 comprises a plate portion 211 extending along a front-rear direction F-R, two side plate portions 212 and two wing portions 213. The contacting unit 22 faces the plate portion 211, is spaced apart from the plate portion 211 and comprises a plate-shaped contacting portion 221*a* and an elastic contacting portion 222 positioned behind the plate-shaped contacting portion 221*a*. Specifically, the contacting unit 22 has a plate body 221 parallel to and spaced apart from the plate portion 211, the plate body 221 has the plate-shaped contacting portion 221*a*, a notch 221*b* and an outer surface 221*c* opposite to the plate portion 211, the elastic contacting portion 222 is formed by separating a part of the plate body 221 and the notch 221*b* is formed along the separation location of the part of the plate body 221. The elastic contacting portion 222 has an elastic arm 222*a* connected to the plate-shaped contacting portion 221*a* and an extending section 222*b*, the elastic arm 222*a* extends along the front-rear direction F-R and a distal end of the elastic arm 222*a* is higher than the outer surface 221*c* of the plate body 221, the extending section 222*b* is bent from the distal end of the elastic arm 222*a* and extending obliquely and rearwardly, and a distal end of the extending section 222*b* enters into the notch 221*b* so as to not be higher than the outer surface 221*c* of the plate body 221. The elastic arm 222*a* has a downward extending section 222*c* which extends rearwardly and obliquely toward a direction close to the plate portion 211 and an upward extending section 222*d* which extends rearwardly and obliquely from the downward extending section 222*c* toward a direction away from the plate portion 211 and is connected to the extending section 222*b*, the downward extending section 222*c* and the upward extending section 222*d* pass through the notch 221*b* and a connected location between the downward extending section 222*c* and the upward extending section 222*d* is positioned between the notch 221*b* and the plate portion 211. The downward extending section 222*c* and the upward extending section 222*d* which extends between the plate body 221 and the plate portion 211 may allow a length of the elastic arm 222*a* to be increased.

The two side plate portions 212 of the base unit 21 are bent respectively from two sides of the plate portion 211 parallel to the front-rear direction F-R and extend so as to respectively at least partially cover two side gaps between two side edges of the plate portion 211 and two side edges of the plate body 221. The two wing portions 213 extends respectively from two sides of a front end of the plate portion 211 toward two opposite directions, and the two wing portions 213 are respectively positioned in front of the two side plate portions 212. The base unit 21 further comprises a latching portion 214 formed by separating a part of the plate portion 211, the latching portion 214 extends rearwardly along the front-rear direction F-R and extends obliquely toward a direction away from the plate body 221. The connecting piece 23 connects the front end of the plate portion 211 and a front end of the plate body 221.

The tail unit 24 is connected to a rear end of the plate portion 211, the tail unit 24, along the front-rear direction F-R, comprises a positioning portion 241 connected to the plate portion 211, a conductor fixing portion 242 connected to the positioning portion 241 and used to clamp and fix a part of the conductor 71 of a cable 7 without the corresponding insulating covering 72 (see FIG. 3), and an insulating covering fixing portion 243 connected to the conductor fixing portion 242 and used to clamp and fix a part of the cable 7 with the corresponding insulating covering 72. The positioning portion 241 comprises two piece bodies 241*a* facing each other, spaced apart from each other and higher than the outer surface 221*c* of the plate body 221. By that, the two side plate portions 212 at least partially cover the two side gaps between the two side edge of the plate portion 211 and the two side edge of the plate body 221 respectively and by that the distal end of the extending section 222*b* of the elastic contacting portion 222 enters into the notch 221*b*, it may prevent hooking and entangling between one conductive terminal 2 and another conductive terminal 2 or between the conductive terminal 2 and the cable 7 during manufacturing, and in turn prevent the conductive terminal 2 from being damaged. In an embodiment, these constituent components of the conductive terminal 2 are integrally formed from a metal sheet.

It should be noted that, in the embodiment, the front-rear direction F-R of the first connector 100 and the front-rear F-R direction of the second connector 200 each are defined as the front at a mating side between the first connector 100 and the second connector 200 and the rear at a side connected to the corresponding cable 7, therefore the front-rear direction F-R of the first connector 100 and the front-rear direction F-R of the second connector 200 are respectively indicated by two different arrows in FIG. 1 to FIG. 3.

Referring to FIG. 3 and FIG. 8 to FIG. 10, the first insulating housing 1 has a main body 10 and a locking portion 13. The main body 10 has a first mating portion 11, a first mounting portion 12 integrally connected with the first mating portion 11, a plurality of terminal grooves 4 each penetrating the first mating portion 11 and the first mounting portion 12, a plurality of first insertion slots 111 formed in the first mating portion 11 and respectively communicated with the plurality of terminal grooves 4, and a top wall 101 of the main body 10. The top wall 101 has a front side edge 102 positioned at the first mating portion 11 and a rear side edge 103 positioned at the first mounting portion 12. The plurality of terminal grooves 4 respectively receive the plurality of conductive terminals 2. Each terminal groove 4 is provided with two side groove portions 41 respectively receiving the two wing portions 213 of the conductive terminal 2, a step portion 42 used to stop the latching portion 214 of the conductive terminal 2, a transverse wall 43 and a protrusion 44 protruding rearwardly from the transverse wall 43 therein.

When the conductive terminal 2 is mounted, the conductive terminal 2 is inserted into the terminal groove 4 from an opening of the terminal groove 4 at the first mounting portion 12 and move in the terminal groove 4 toward the first mating portion 11, when the conductive terminal 2 reaches a predetermined position, the two wing portions 213 of the conductive terminal 2 are respectively receiving in the two side groove portions 41, so that the conductive terminal 2 cannot move toward the front and is limited in an up-down direction, and the latching portion 214 of the conductive terminal 2 has elasticity, during movement of the conductive terminal 2 in the terminal groove 4, the latching portion 214 is compressed and displaced inwardly, and the latching portion 214 returns to its original position when the conductive terminal 2 reaches the predetermined position so that the latching portion 214 may abut against the step portion 42 when the conductive terminal 2 is reversely moved (see FIG.

19), thus the conductive terminal 2 cannot be further withdrawn and in turn the conductive terminal 2 is limited in position.

Moreover, a profile of the two piece bodies 241*a* of the positioning portion 241 of the conductive terminal 2 is matched with a profile of the protrusion 44 so as to allow the protrusion 44 to be positioned between the two piece bodies 241*a*, in the embodiment, the two piece bodies 241*a* are two L-shapes which are bent toward each other and cooperatively form a general U-shape profile, the profile of the protrusion 44 is also a U-shape. Also, the first terminal holding member 5 is engaged with the first mounting portion 12 (see FIG. 1 and FIG. 2) and has a plurality of first positioning plate portions 51 respectively entering into the plurality of terminal grooves 4, each first positioning plate portion 51 and the transverse wall 43 in the corresponding terminal groove 4 cooperatively interpose and position the two piece bodies 241*a* of the conductive terminal 2 therebetween.

Figure 10:
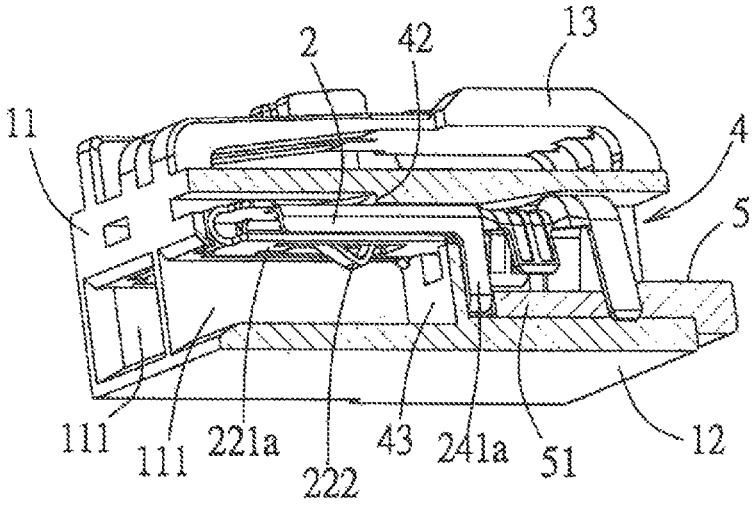
FIG. 10 is a view of FIG. 9 viewed from another angle.
Figure 11:
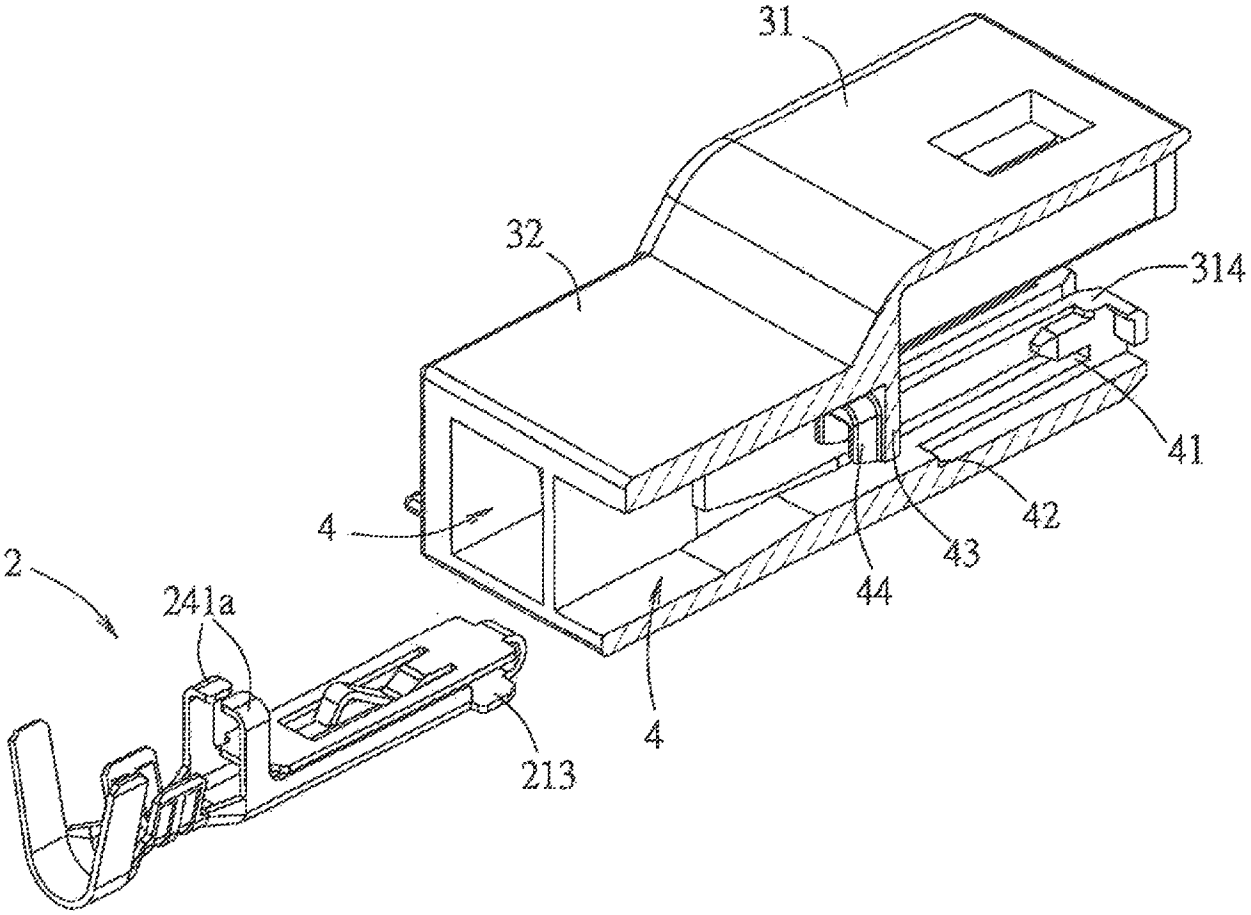
FIG. 11 is an exploded perspective view partially sectioned and illustrating a corresponding relationship between a terminal groove and a conductive terminal of the second connector of the embodiment in structure.
Figure 12:
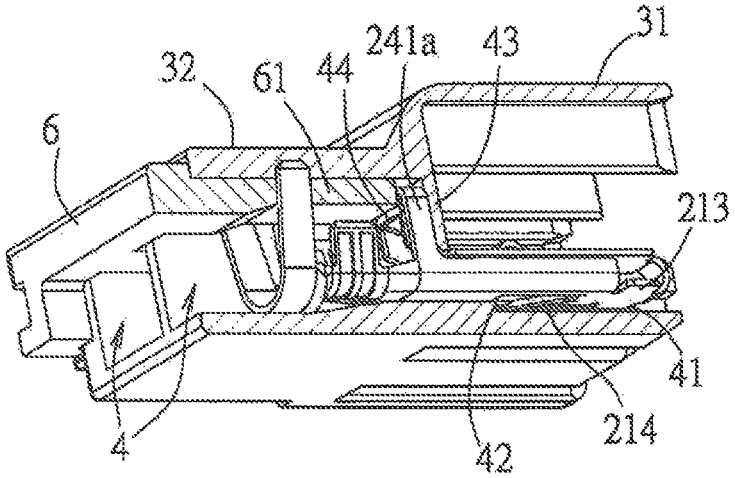
FIG. 12 is a perspective view partially sectioned and illustrating the conductive terminal is provided in the terminal groove in the second connector of the embodiment and illustrating a functional relationship among the terminal groove, the conductive terminal and a second terminal holding member.
Figure 13:
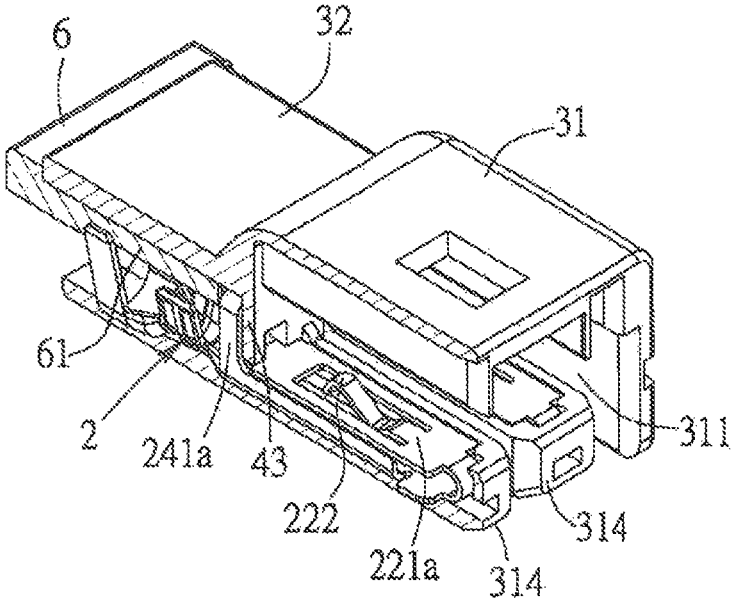
FIG. 13 is a view of FIG. 12 viewed from another angle.

Referring to FIG. 1 to FIG. 3, specifically, the first terminal holding member 5 further has two first elastic plate portions 52 respectively positioned at two sides of the plurality of first positioning plate portions 51 and face each other, the two first elastic plate portions 52 each have a first positioning groove 53. The first insulating housing 1 further has two first positioning blocks 15 respectively corresponding to the two first positioning grooves 53 and each have a wedge-shape. Before the first terminal holding member 5 is assembled to the first insulating housing 1, an oblique surface 151 of the first positioning block 15 faces the first elastic plate portion 52, so that the first terminal holding member 5 easily slides over and passes through the first positioning block 15 when the first terminal holding member 5 is assembled to the first insulating housing 1, when the first terminal holding member 5 reaches a preset position, the first positioning block 15 enters into the first positioning groove 53, and the first elastic plate portion 52 is stopped to reversely move by an upright surface 152 of the first positioning block 15, and the first positioning block 15 is latched in the first positioning groove 53 so that the first elastic plate portion 52 is limited in the up-down direction in position, and thus the first terminal holding member 5 is engaged with and fixed to the first insulating housing 1. Referring to FIG. 10, when the conductive terminal 2 is provided in the first insulating housing 1, the elastic contacting portion 222 protrudes into the corresponding first insertion slot 111 and the plate-shaped contacting portion 221*a* is exposed to the corresponding first insertion slot 111.

Referring to FIG. 3 and FIG. 11 to FIG. 13, the second insulating housing 3 has a second mating portion 31, a second mounting portion 32 integrally connected to the second mating portion 31 and a plurality of terminal grooves 4 each penetrating the second mating portion 31 and the second mounting portion 32. The second mating portion 31 is used to mate with the first mating portion 11, and has a second insertion slot 311 and a plurality of protruding blocks 314 protruding into the second insertion slot 311, the plurality of protruding blocks 314 are respectively received in the plurality of first insertion slots 111. The plurality of terminal grooves 4 of the second insulating housing 3 respectively extend from the second mounting portion 32 and respectively extend to the plurality of protruding blocks 314 and are communicated with the second insertion slot 311. A structure inside the terminal groove 4 of the second insulating housing 3 is substantially identical to the structure inside the terminal groove 4 of the first insulating housing 1, and provision of the conductive terminal 2 of the second connector 200 in the terminal groove 4 of the second insulating housing 3 is also identical to the provision of the conductive terminal 2 of the first connector 100 in the terminal groove 4 of the first insulating housing 1. The only difference lies in that the conductive terminal 2 of the second connector 200 is rotated by 180 degrees relative to the conductive terminal 2 of the first connector 100, so that the conductive terminal 2 of the first connector 100 and the conductive terminal 2 of the second connector 200 can be mated with each other. Accordingly, the structure inside the terminal groove 4 of the second insulating housing 3 is rotated by 180 degrees relative to the structure inside the terminal groove 4 of the first insulating housing 1, therefore detailed description on the structure inside the terminal groove 4 of the second insulating housing 3 is omitted.

When the conductive terminal 2 is provided in the second insulating housing 3, the elastic contacting portion 222 protrudes into the second insertion slot 311 and the plate-shaped contacting portion 221*a* is exposed to the second insertion slot 311. Similarly, the second connector 200 further comprises a second terminal holding member 6, the second terminal holding member 6 is engaged with the second mounting portion 32 and has a plurality of second positioning plate portions 61 respectively entering into the plurality of terminal grooves 4, so that the second positioning plate portion 61 and the transverse wall 43 in the corresponding terminal groove 4 cooperatively interpose and position the two piece bodies 241*a* of the corresponding conductive terminal 2. Moreover, referring to FIG. 1 to FIG. 3, the second terminal holding member 6 further has two second elastic plate portions 62 respectively positioned at two sides of the plurality of second positioning plate portions 61 and face each other, the two second elastic plate portions 62 each has a second positioning groove 63. The second insulating housing 3 further has two second positioning blocks 33 respectively corresponding to the two second positioning grooves 63 and each having a wedge-shape. A manner of the second terminal holding member 6 assembled to the second insulating housing 3 is identical to the manner of the first terminal holding member 5 assembled to the first insulating housing 1, so detail description is omitted.

Figure 14:
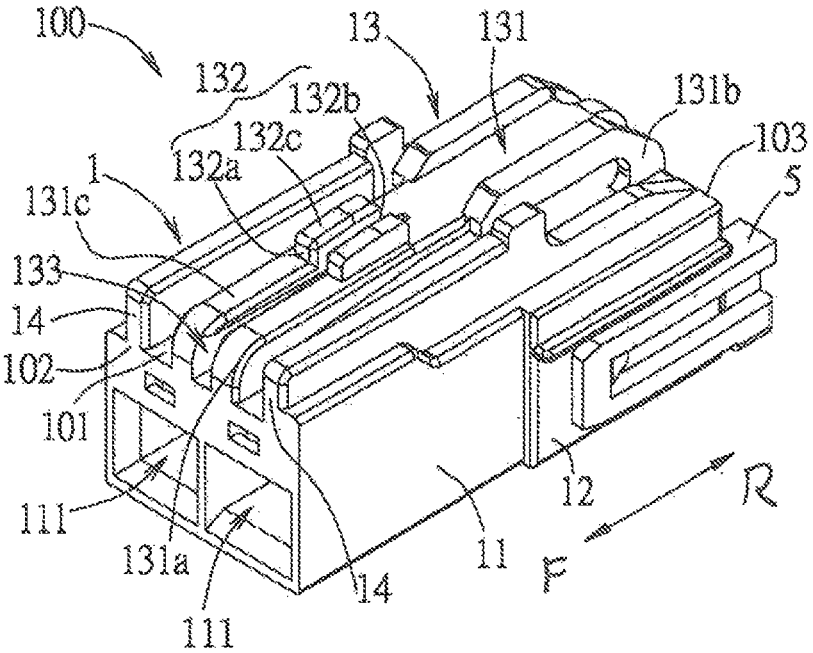
FIG. 14 is a perspective view illustrating the first connector of the embodiment.
Figure 15:
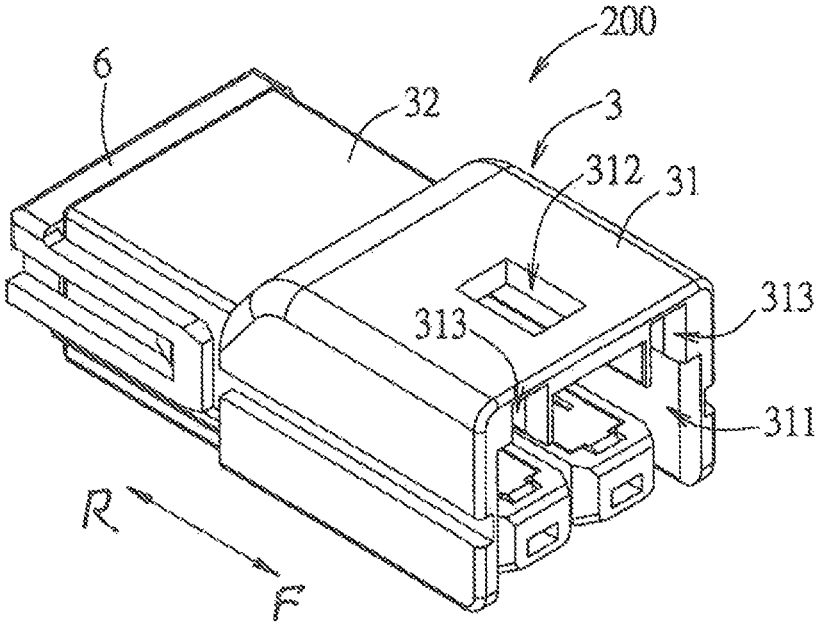
FIG. 15 is a perspective view illustrating the second connector of the embodiment.
Figure 16:
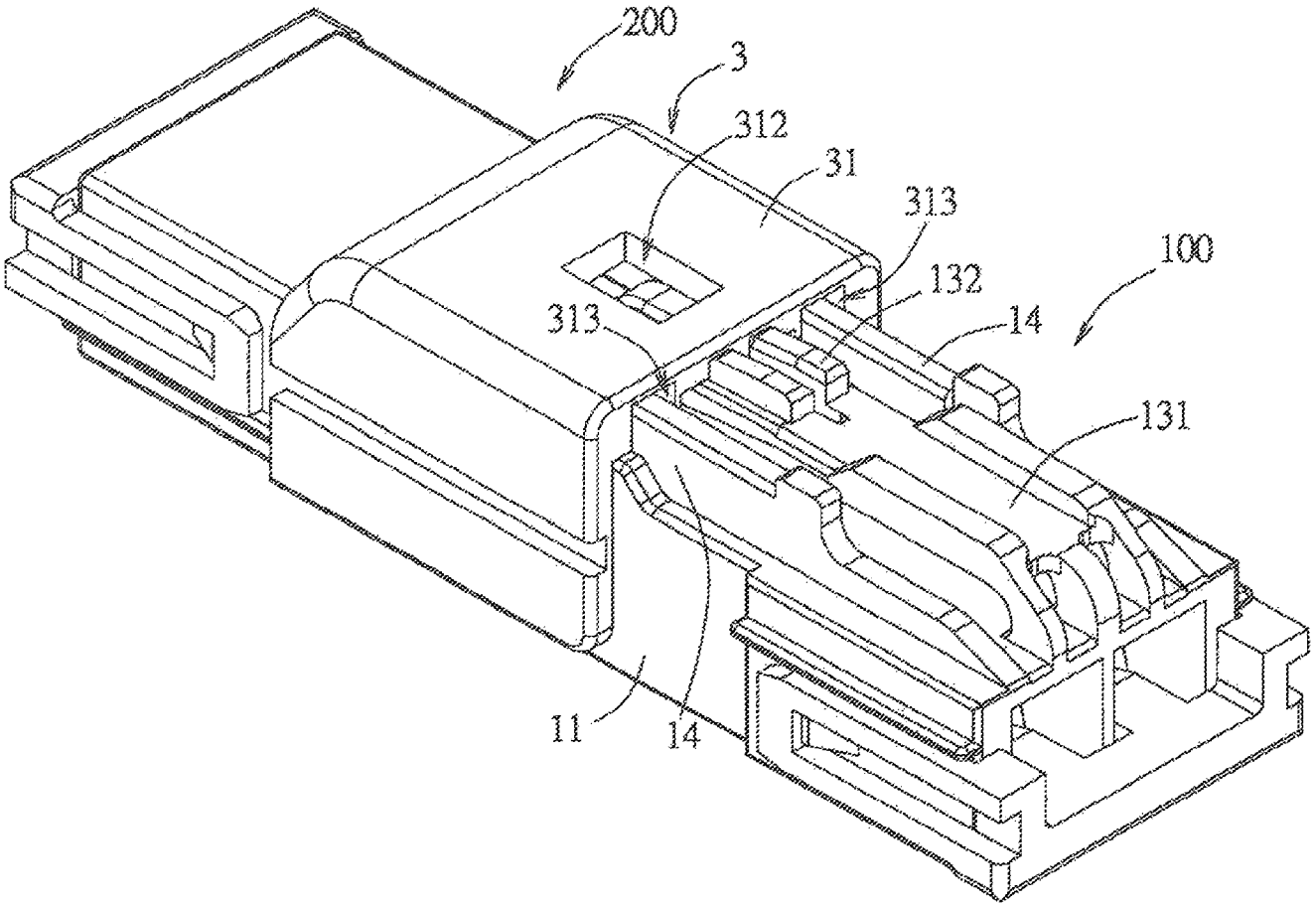
FIG. 16 is a perspective view illustrating a status that a latching block does not enter into an insertion slot when the first connector and the second connector of the embodiment are mated with each other.
Figure 17:
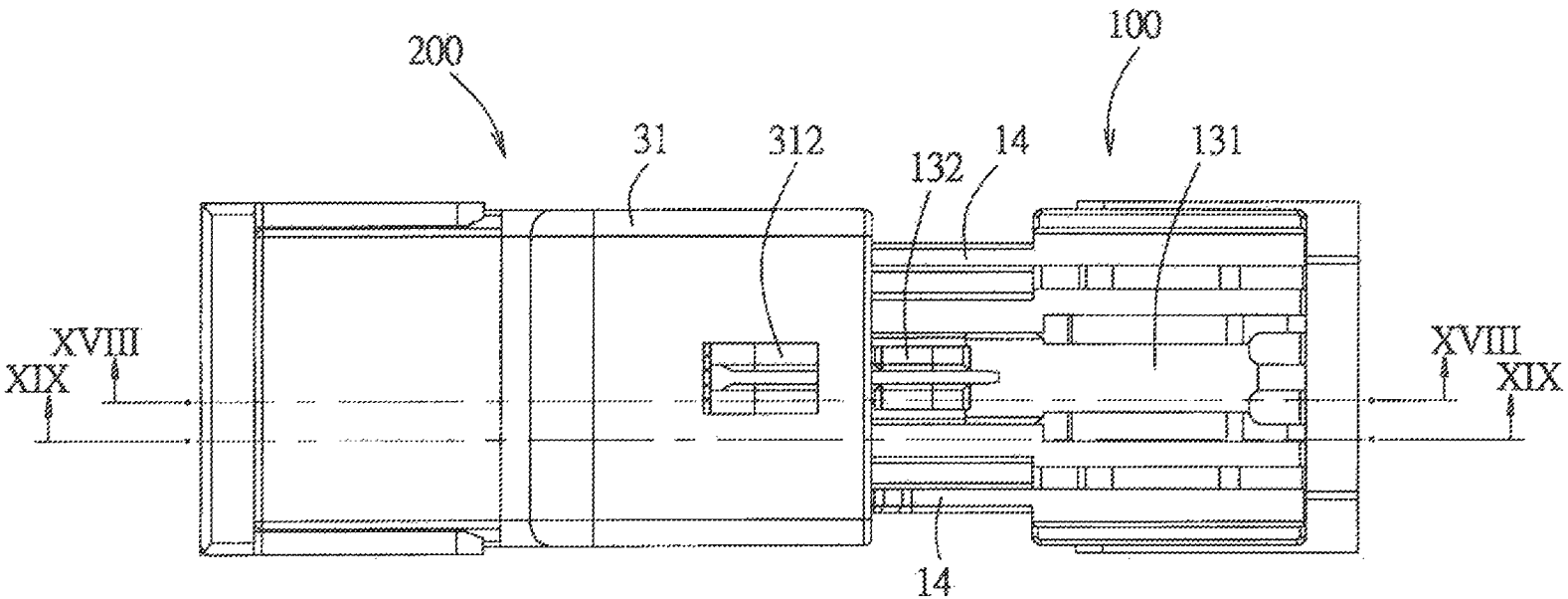
FIG. 17 is a top view of FIG. 16.
Figure 18:
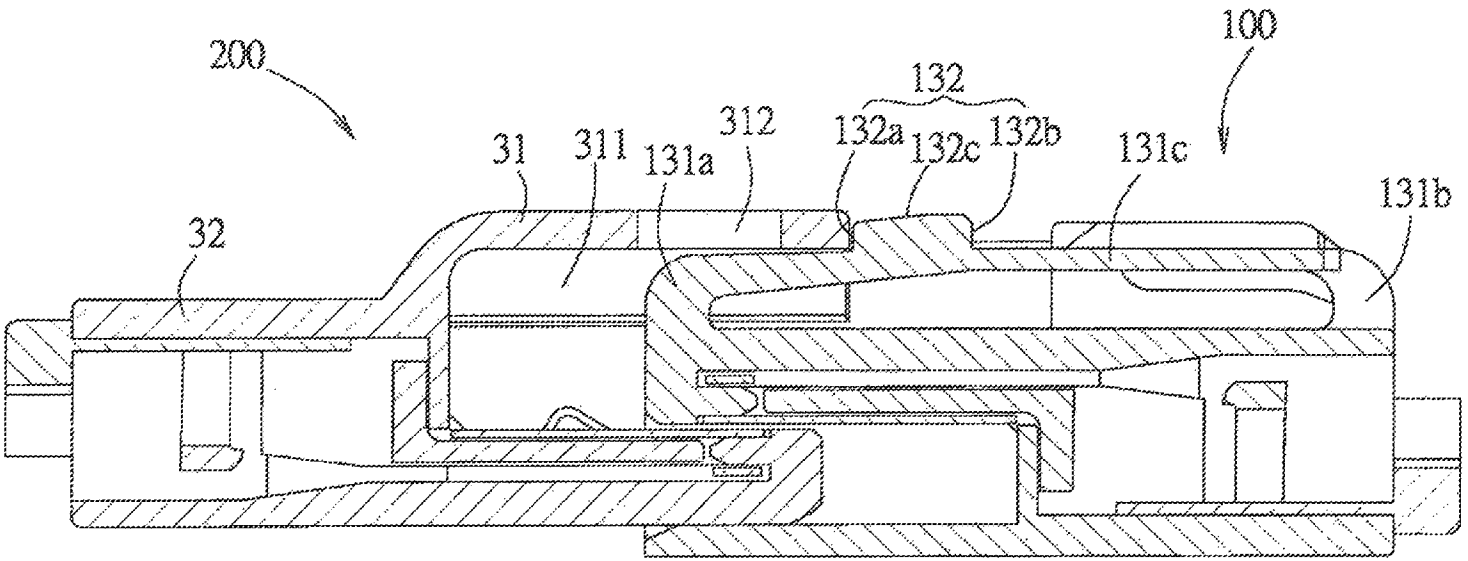
FIG. 18 is a cross sectional view taken along a line XVIII-XVIII of FIG. 17.
Figure 19:
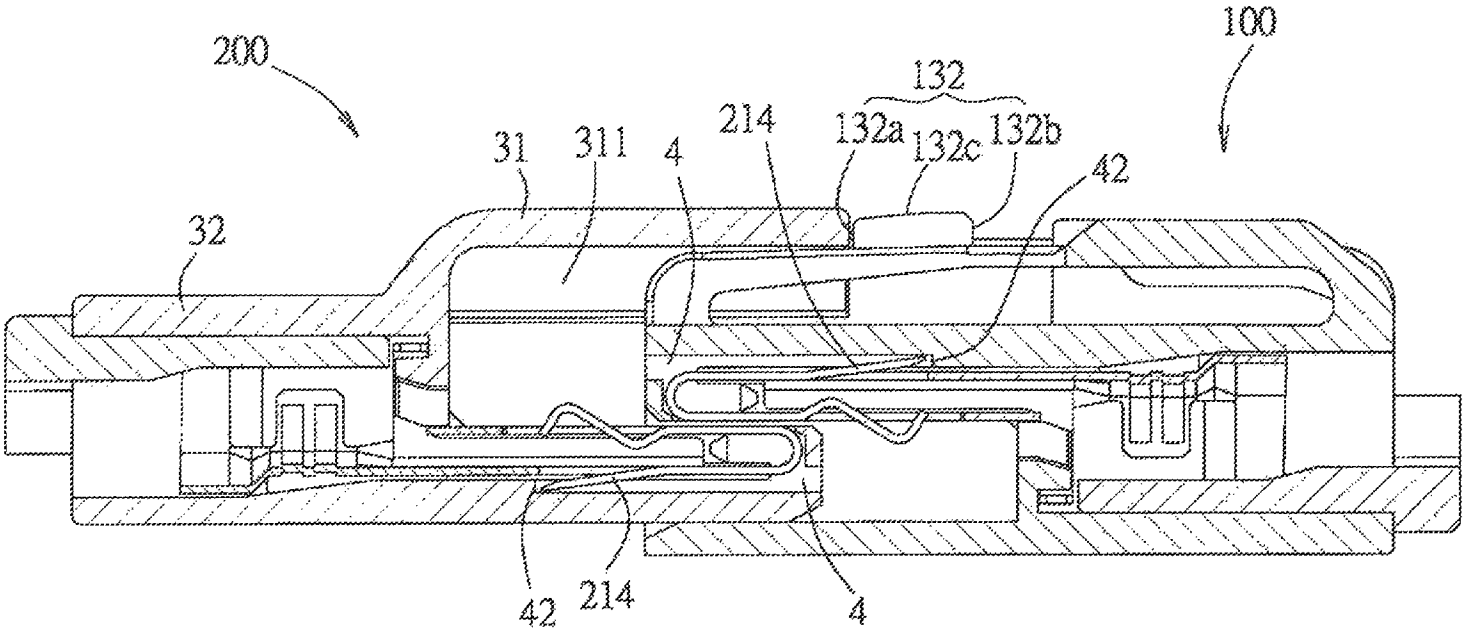
FIG. 19 is a cross sectional view taken along a line XIX-XIX of FIG. 17.
Figure 20:
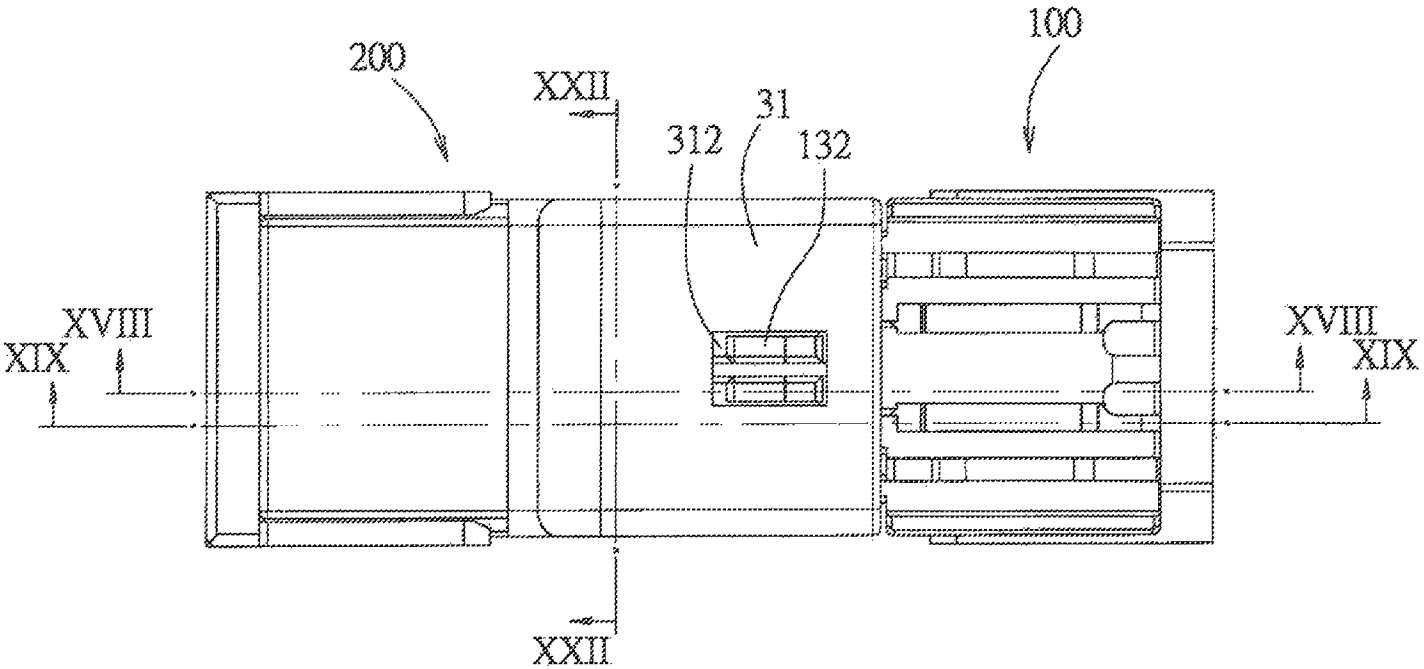
FIG. 20 is a top view illustrating a status that the first connector and the second connector of the embodiment have been mated with each other.
Figure 21:
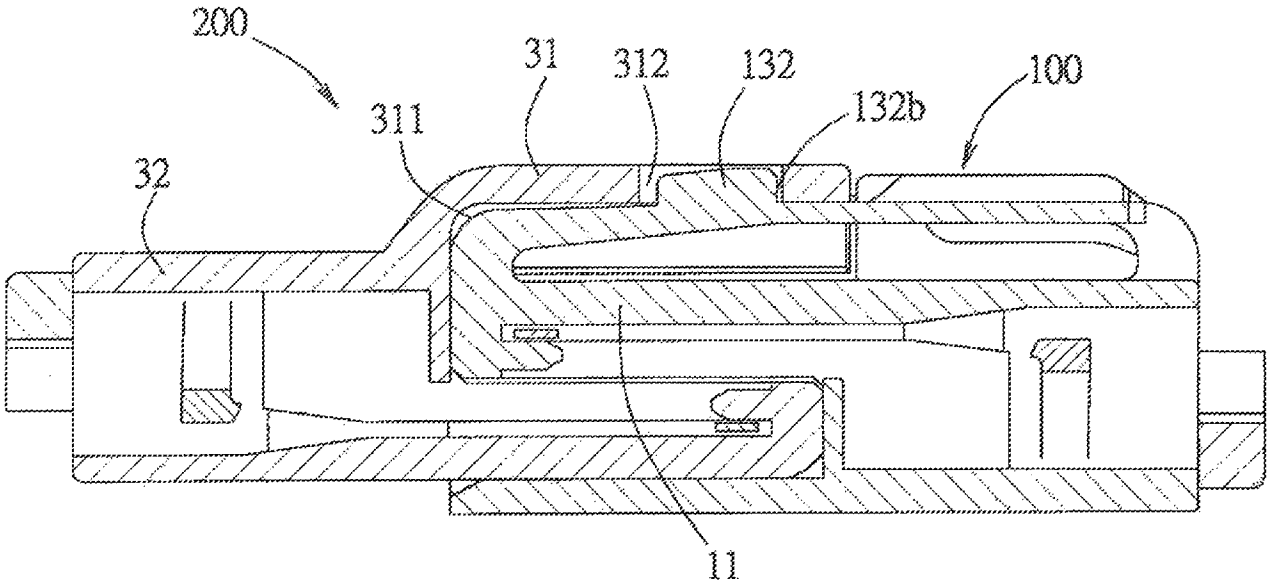
FIG. 21 is a cross sectional view taken along a line XVIII-XVIII of FIG. 20 and illustrating that a latching block has been positioned in the latching groove in the embodiment.

Referring to FIG. 14 and FIG. 15, the locking portion 13 of the first insulating housing 1 has an elastic support member 131 which extends along the front-rear direction F-R and is integrally connected to the top wall 101 and a latching block 132. The elastic support member 131 has a first connecting section 131*a* connected to the top wall 101 and adjacent to the front side edge 102, a second connecting section 131*b* connected to the top wall 101 and adjacent to the rear side edge 103, and an elastic section 131*c* positioned between the first connecting section 131*a* and the second connecting section 131*b* and spaced apart from the top wall 101. By that the first connecting section 131*a* and the second connecting section 131*b* respectively positioned at two ends of the elastic support member 131 are respectively connected to the top wall 101 of the main body 10, that is the elastic support member 131 is closed at the two ends, so that the elastic support member 131 is not easily broken due to pulling.

The latching block 132 is provided on the elastic section 131*c*, and has a front end surface 132*a* and a rear end surface 132*b* which are spaced apart from each other along the front-rear direction and a guiding surface 132*c* which is positioned between the front end surface 132*a* and rear end surface 132*b*, the front end surface 132*a* is upright on the elastic support member 131 and is close to the first connecting section 131*a* relative to the rear end surface 132*b*, and the guiding surface 132*c* extends obliquely and upwardly from the front end surface 132*a*. The locking portion 13 further has a slot 133, the slot 133 extends from the first connecting section 131*a* of the elastic support member 131 to the elastic section 131*c* along the front-rear direction F-R and at least passes through the latching block 132, that is, the latching block 132 is divided into two parts by the slot 133. The slot 133 may lower the rigidity of the elastic support member 131 so that the latching block 132 is more easily elastically pressed down.

Figure 22:
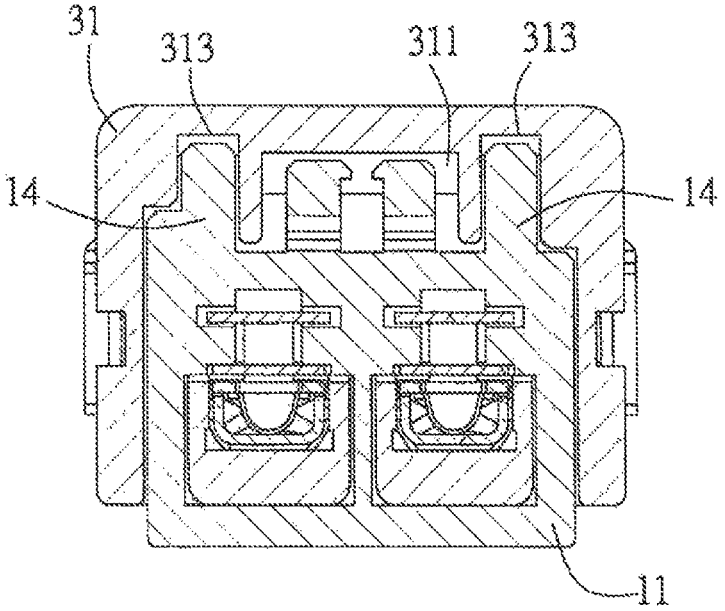
FIG. 22 is a cross sectional view taken along a line XXII-XXII of FIG. 20 and illustrating a functional relationship between a key of the first connector and a key groove of the second connector in the embodiment.

The second insertion slot 311 of the second insulating housing 3 receives the first mating portion 11 and a part of the locking portion 13, and the second mating portion 31 further has a latching groove 312 receiving the latching block 132, the latching groove 312 is communicated with the second insertion slot 311. Moreover, the first insulating housing 1 further has two keys 14 respectively positioned at two sides of the locking portion 13 and parallel to the front-rear direction F-R, the two keys 14 are respectively connected to the top wall 101 and each extend rearwardly from the front side edge 102 along the front-rear direction F-R, the second mating portion 31 of the second insulating housing 3 further has two key grooves 313 respectively receiving the two keys 14, and the two keys grooves 313 are communicated with the second insertion slot 311. That the two keys 14 are respectively engaged with the two key grooves 313 may prevent the first mating portion 11 of the first connector 100 from being improperly inserted into the second insertion slot 311 of the second connector 200. Moreover, the two keys 14 may have different cross sectional profiles (see FIG. 22), the cross sectional profiles of the two keys 14 may be adjusted and the corresponding key grooves 313 may be also correspondingly adjusted, so that different electrical connector assemblies each have the keys 14 and the key grooves 313 which have different cross sectional profiles, and thus it may prevent different electrical connector assemblies from being improperly assembled therebetween with respect to a system having a plurality of electrical connector assemblies.

Referring to FIG. 16 to FIG. 19, during mating of the first connector 100 and the second connector 200, only the two keys 14 of the first connector 100 respectively correspond to the two keys grooves 313 of the second connector 200 in position and profile, can the first mating portion 11 enter into the second insertion slot 311, Then, the front end surface 132*a* of the latching block 132 of the first connector 100 will abut against the second insulating housing 3, because the front end surface 132*a* of the latching block 132 is an upright surface, only a relative large force is applied, can the latching block 132 be pressed down so as to enter into the second insertion slot 311, which can increase a hand feeling of a user during the mating operation on the first connector 100 and the second connector 200 so as to easily determine whether a locking between the first connector 100 and the second connector 200 is completed. Moreover, a chamfer is formed at a connected location between the front end surface 132*a* and the guiding surface 132*c* of the latching block 132, and the guiding surface 132*c* allows the latching block 132 to easily slide relative to the second insulating housing 3 and enter into the latching groove 312.

Figure 23:
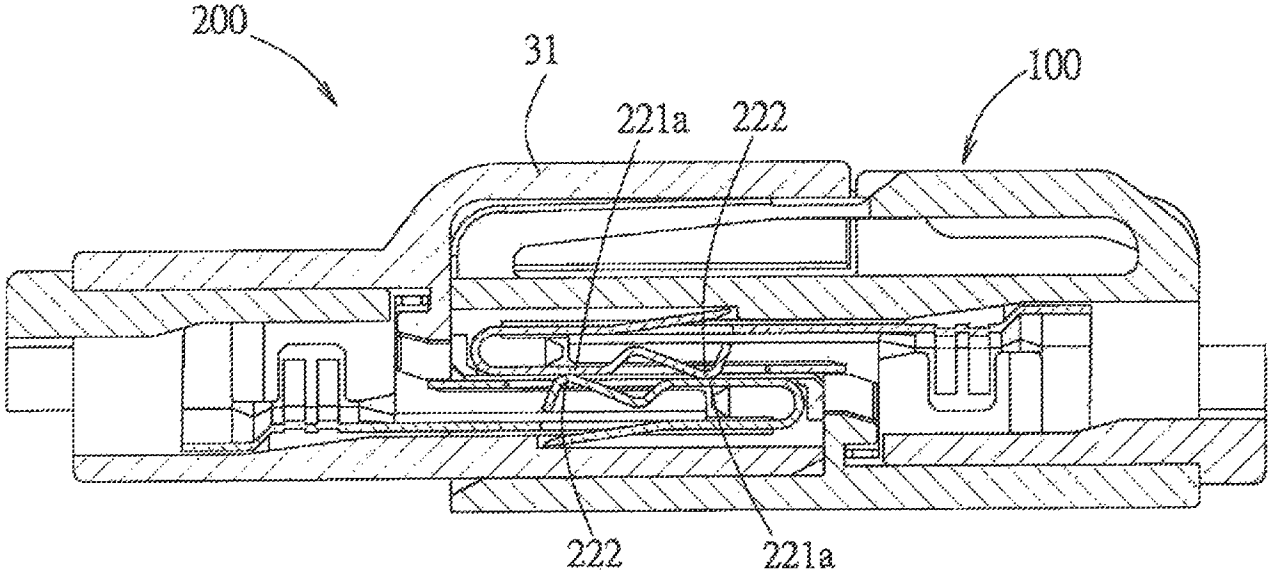
FIG. 23 is a cross sectional view taken along a line XIX-XIX of FIG. 20 and illustrating that the conductive terminal of the first connector and the conductive terminal of the second connector have been mated with each other to form two contacting regions in the embodiment.

Referring to FIG. 20 to FIG. 23, when the mating between the first connector 100 and the second connector 200 has been completed, the latching block 132 of the first connector 100 has been positioned in the latching groove 312 of the second connector 200, the rear end surface 132*b* of the latching block 132 may abut against a wall surface defining the latching groove 312 so as to prevent the first connector 100 from being withdrawn, and in turn allow the first connector 100 and the second connector 200 to be fixed relative to each other and be stably connected with each other. Moreover, as shown in FIG. 23, in every two mated conductive terminals 2 between the first connector 100 and the second connector 200, the elastic contacting portion 222 of one conductive terminal 2 contacts the plate-shaped contacting portion 221*a* of the other conductive terminal 2 and the elastic contacting portion 222 of the other conductive terminal 2 contacts the plate-shaped contacting portion 221*a* of the one conductive terminal 2, so that two contacting regions are formed between the every two mated conductive terminals 2, which provides a more stable and more reliable electrical connection and can promote performance and stability under long-term use.

Consequently, due to the conductive terminal 2 of the first connector 100 and the conductive terminal 2 of the second connector 200 being identical in structure and dimension, the conductive terminal 2 of the first connector 100 and the conductive terminal 2 of the second connector 200 may be manufactured with the same mold, not only manufacturing cost may be saved, but also the number and inventory of the components can be reduced.

As illustrated in FIGS. 24-48 a second embodiment is described. As with the previous description, it should be noted that, in the embodiment, the front-rear direction F-R of the first connector 2100 and the front-rear direction F-R of the second connector 2200 each are defined as the front at a mating side between the first connector 2100 and the second connector 2200 and the rear at a side connected to the corresponding cable 2007, therefore the front-rear direction F-R of the first connector 2100 and the front-rear direction F-R of the second connector 2200 are respectively indicated by two different arrows in FIG. 24 to FIG. 27.

Figure 26:
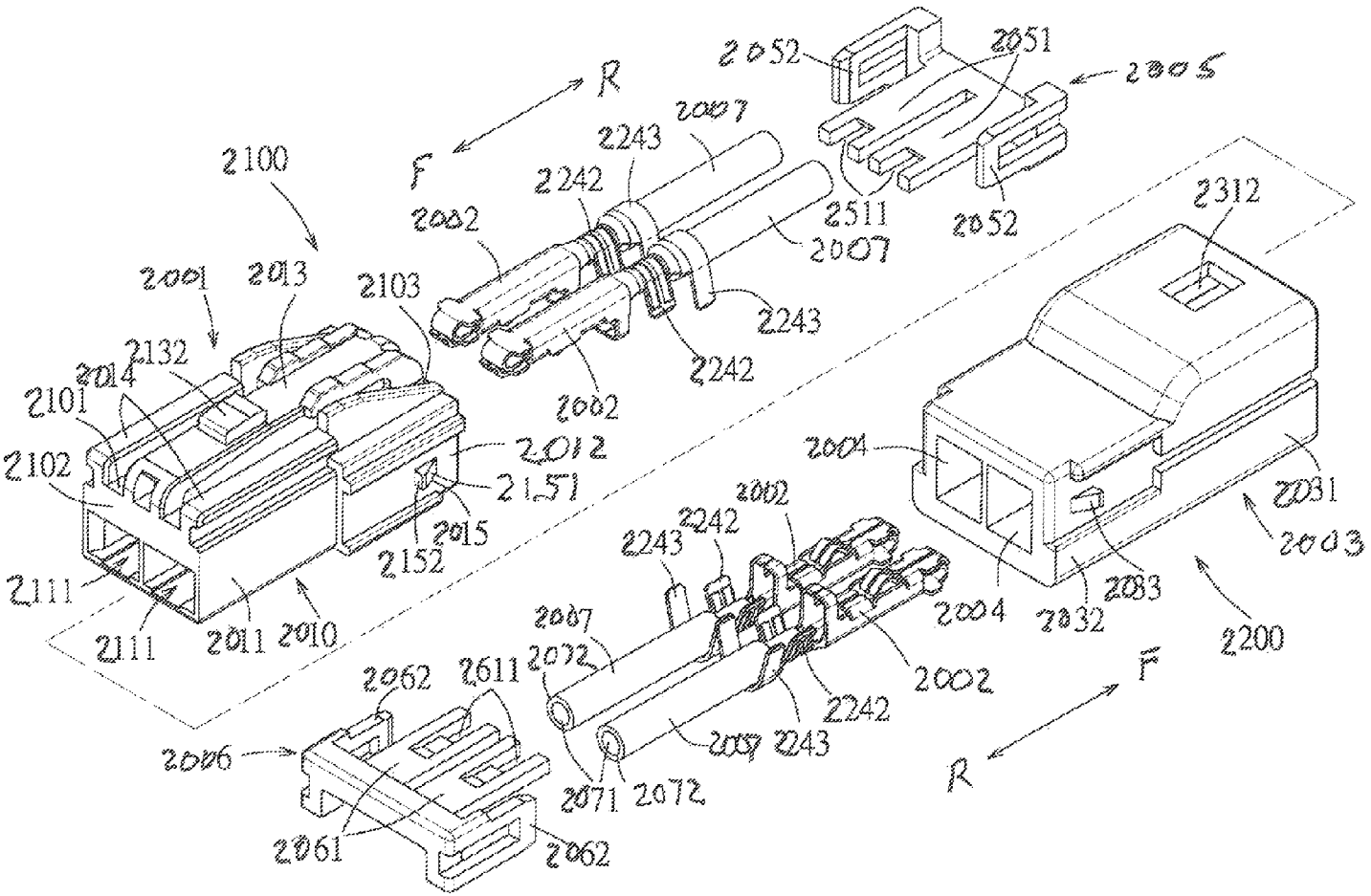
FIG. 26 is an exploded perspective view illustrating components of the first connector and the second connector of the embodiment.
Figure 27:
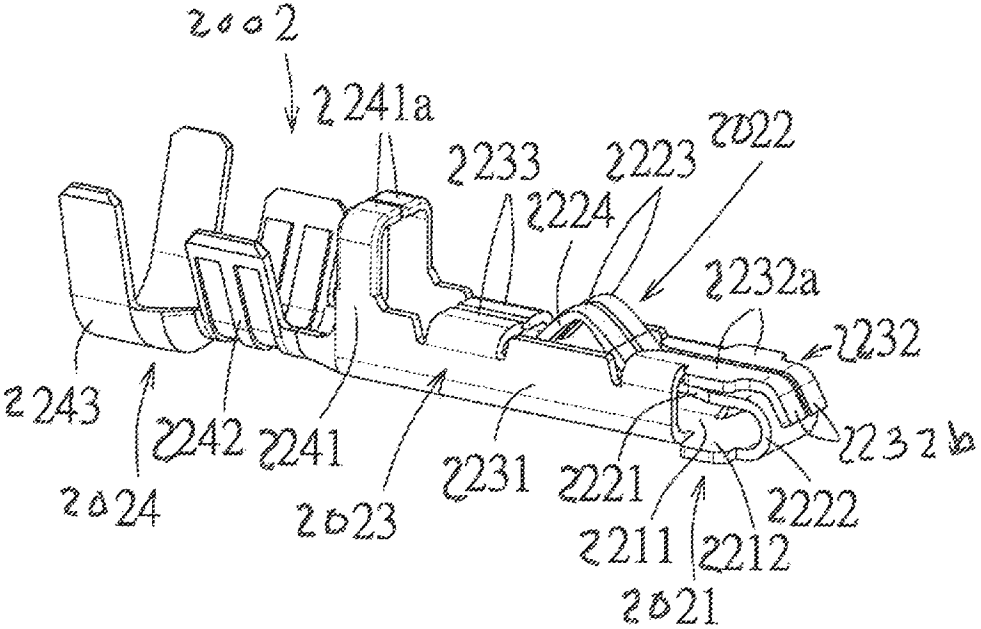
FIG. 27 is a perspective view illustrating a conductive terminal of the embodiment.
Figure 30:
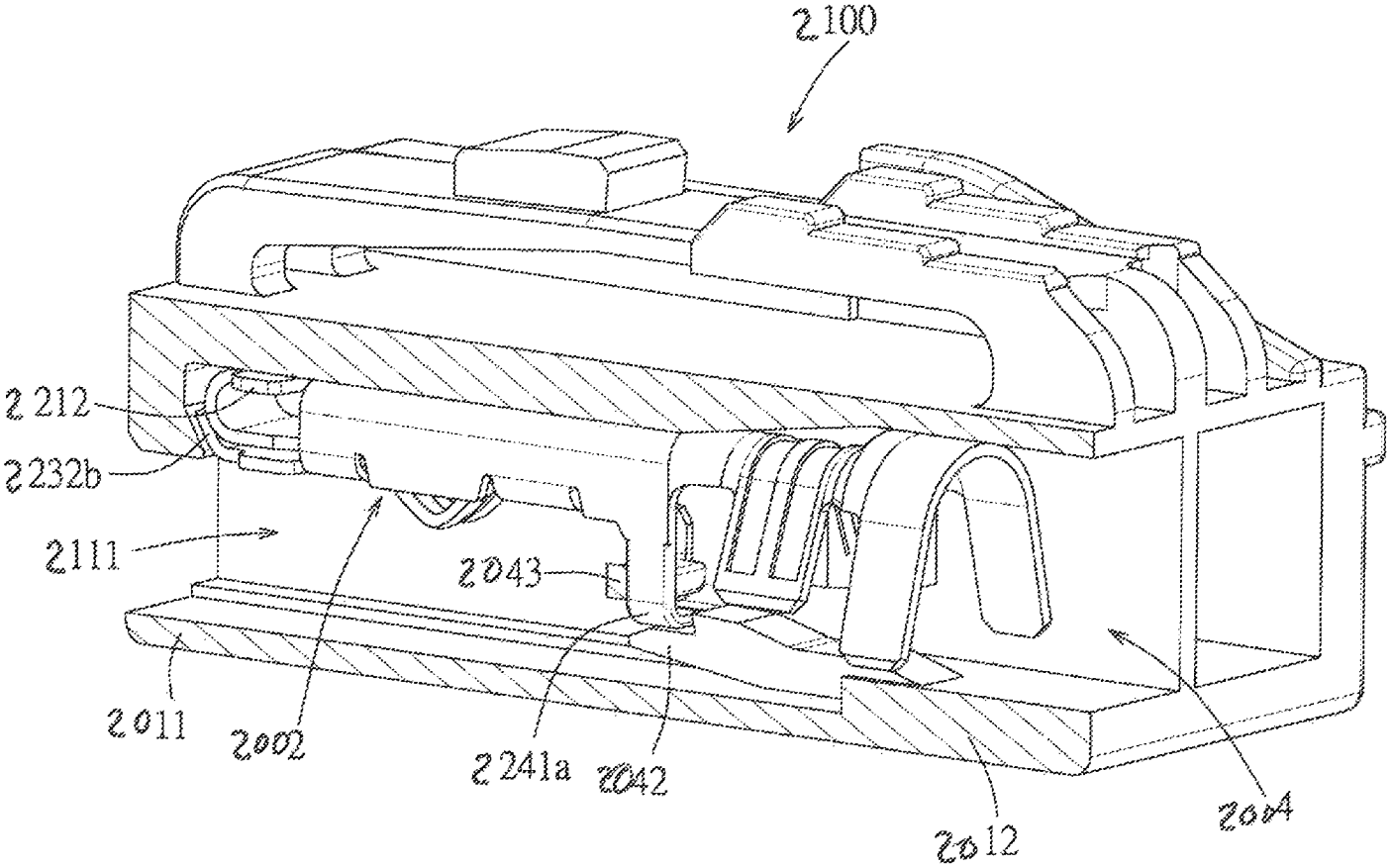
FIG. 30 is a perspective view partially sectioned and illustrating that the conductive terminal of the first connector of the embodiment is provided in the terminal groove.

Referring to FIG. 26 and FIG. 30, each conductive terminal 2002 of the first connector 2100 and the second connector 2200 has a base unit 2023, two elastic contact pieces 2022, two contact plates 2232, two protect plates 2233 and a tail unit 2024. The base unit 2023 has a bottom plate 2021 and two side plates 2231. The bottom plate 2021 extends along a front-rear direction F-R, and has a plate portion 2211 and two wing portions 2212 respectively extending from two sides of a front end of the plate portion 2211 toward two opposite directions, the two side plates 2231 integrally extend upwardly from a left side and a right side of the plate portion 2211 of the bottom plate 2021 respectively. The two elastic contact pieces 2022 are arranged side by side, specifically, each elastic contact piece 2022 has a connecting portion 2222 bent upwardly from a front end of the bottom plate 2021 and having a curved-shape, an arm portion 2221 extending rearwardly from the connecting portion 2222, positioned above the bottom plate 2021 and spaced apart from the bottom plate 2021, a first contact portion 2223 positioned at a rear end of the arm portion 2221, and an extending portion 2224 bent from a rear end of the first contact portion 2223 and extending obliquely and downwardly toward the rear.

The two contact plates 2232 are bent respectively from two upper edges of two front ends of the two side plates 2231 toward each other, and the two protect plates 2233 are bent respectively from two upper edges of two rear ends of the two side plates 2231 toward each other. Herein, the two side plates 2231 at least partially cover two side gaps between the bottom plate 2021 and the two arm portions 2221 respectively, and the two side plates 2231 are positioned respectively behind the two wing portions 2212. Each contact plate 2232 has a second contact portion 2232*a* and a guide portion 2232*b* positioned in front of the second contact portion 2232*a*, the second contact portion 2232*a* is positioned above the arm portion 2221 of the corresponding elastic contact piece 2022 so as to protect the arm portion 2221, and the second contact portion 2232*a* can be further used for electrical connection, the guide portion 2232*b* extends obliquely and downwardly toward the front and substantially covers an upper half part region of the corresponding connecting portion 2222 so as to protect the corresponding connecting portion 2222. The two protect plates 2233 are respectively positioned behind the two extending portions 2224. It should be noted that, the two first contact portions 2223 respectively extend upwardly from two rear ends of the two contact plates 2232 and respectively are higher than the two second contact portions 2232*a*, and two distal ends of the two extending portions 2224 enter into between the two side plates 2231 and are not higher than the two upper edges of the two side plates 2231.

The tail unit 2024 is connected to a rear end of the bottom plate 2021, and the tail unit 2024, along the front-rear direction F-R, has a positioning portion 2241 connected to the plate portion 2211, a conductor fixing portion 2242 positioned behind the positioning portion 2241 and used to clamp and fix a part of the conductor 2071 of a cable 2007 without an insulating covering 2072, and an insulating covering fixing portion 2243 positioned behind the conductor fixing portion 2242 and used to clamp and fix a part of the cable 2007 with the insulating covering 2072. By that the two side plate portions 2231 at least partially cover the two side gaps between the two side edges of the plate portion 2211 and the two side edges of the two arm portions 2221 respectively, by that the two distal ends of the two extending portion 2224 enter into between the two side plates 2231 and by that the two protect plates 2233 cover a space behind the two extending portions 2224, it may prevent hooking and entangling between one conductive terminal 2002 and another conductive terminal 2002 or between the conductive terminal 2002 and the cable 2007 during manufacturing, and in turn prevent the conductive terminal 2002 from being damaged. In an embodiment, these constituent components of the conductive terminal 2002 are integrally formed from a metal sheet.

Figure 28:
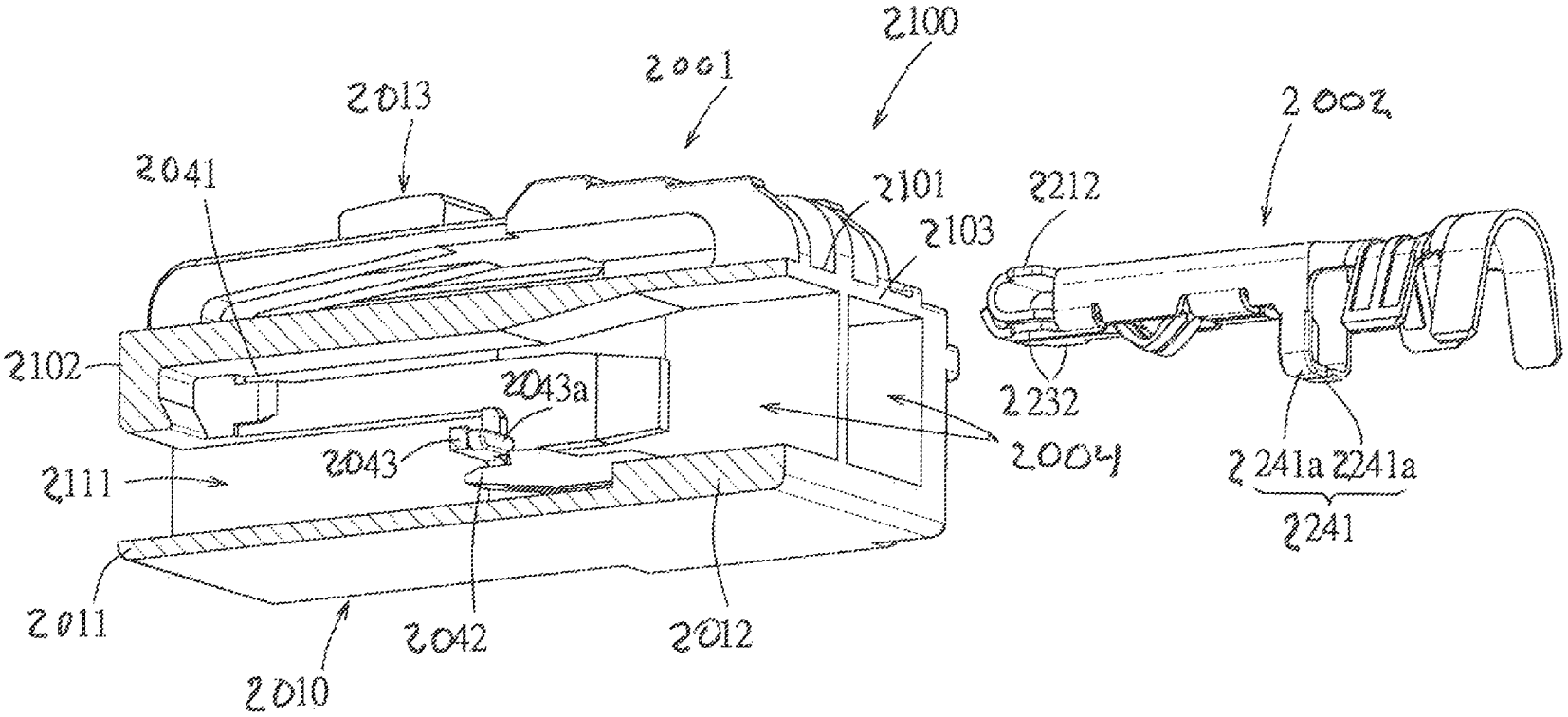
FIG. 28 is an exploded perspective view partially sectioned and illustrating a corresponding relationship between a terminal groove and the conductive terminal of the first connector of the embodiment in structure.
Figure 29:
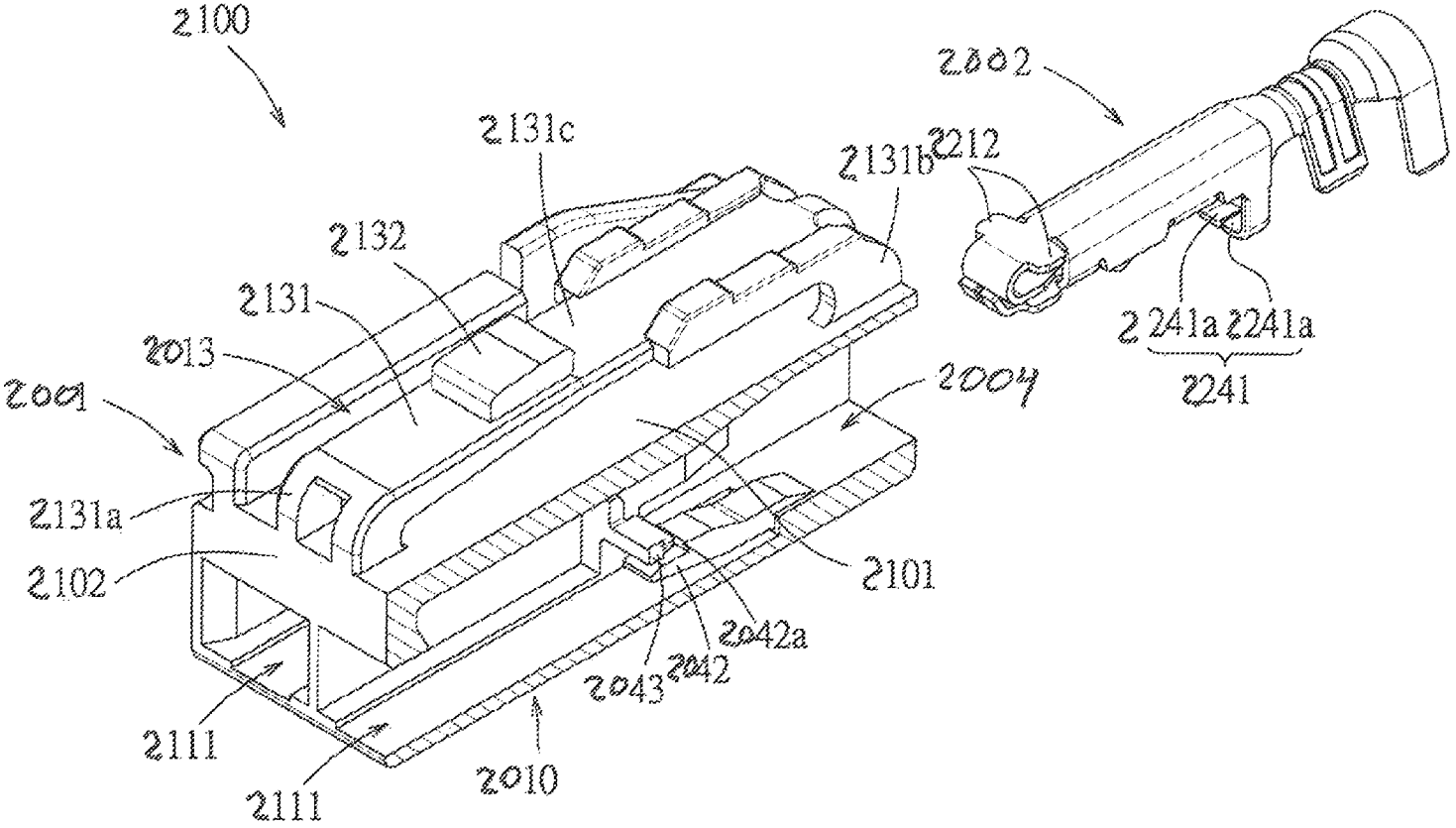
FIG. 29 is a view of FIG. 28 viewed from another angle.

Referring to FIG. 28, FIG. 29 and FIG. 30, the first insulating housing 1 has a main body 2010 and a locking portion 2013. The main body 2010 has a top wall 2101, a first mating portion 2011, a first mounting portion 2012 integrally connected with the first mating portion 2011, a plurality of terminal grooves 2004 each penetrating the first mating portion 2011 and the first mounting portion 2012, a plurality of first insertion slots 2111 each formed in the first mating portion 2011 and communicated with the plurality of terminal grooves 2004. The top wall 2101 has a front side edge 2102 positioned at the first mating portion 2011 and a rear side edge 2103 positioned at the first mounting portion 2012. The plurality of terminal grooves 2004 respectively receive the plurality of conductive terminals 2002. In combination with referring to FIG. 31 and FIG. 32, each terminal groove 2004 is provided with two side groove portions 2041, an elastic finger portion 2042 and a stopping block 2043 therein. The two side groove portions 2041 respectively receive the two wing portions 2212 of the corresponding conductive terminal 2002, the elastic finger portion 2042 is formed with a step portion 2042*a* facing the front (see FIG. 29), the stopping block 2043 is positioned in front of the step portion 2042*a*, is spaced apart from the step portion 2042*a* and is formed with a stopping protrusion 2043*a* facing the rear (see FIG. 28). And the positioning portion 2241 of each conductive terminal 2002 forms an annular shape and has two piece bodies 2241*a* facing each other, spaced apart from each other and higher than the two contact plates 2232, and two front edges of the two piece bodies 2241*a* abut against a rear end surface of the stopping block 2043, two rear edges of the two piece bodies 2241*a* abut against the step portion 2042*a* of the elastic finger portion 2042, so that the positioning portion 2241 is positioned between the elastic finger portion 2042 and the stopping block 2043 and in turn the conductive terminal 2002 is positioned in the terminal groove 2004.

Figure 31:
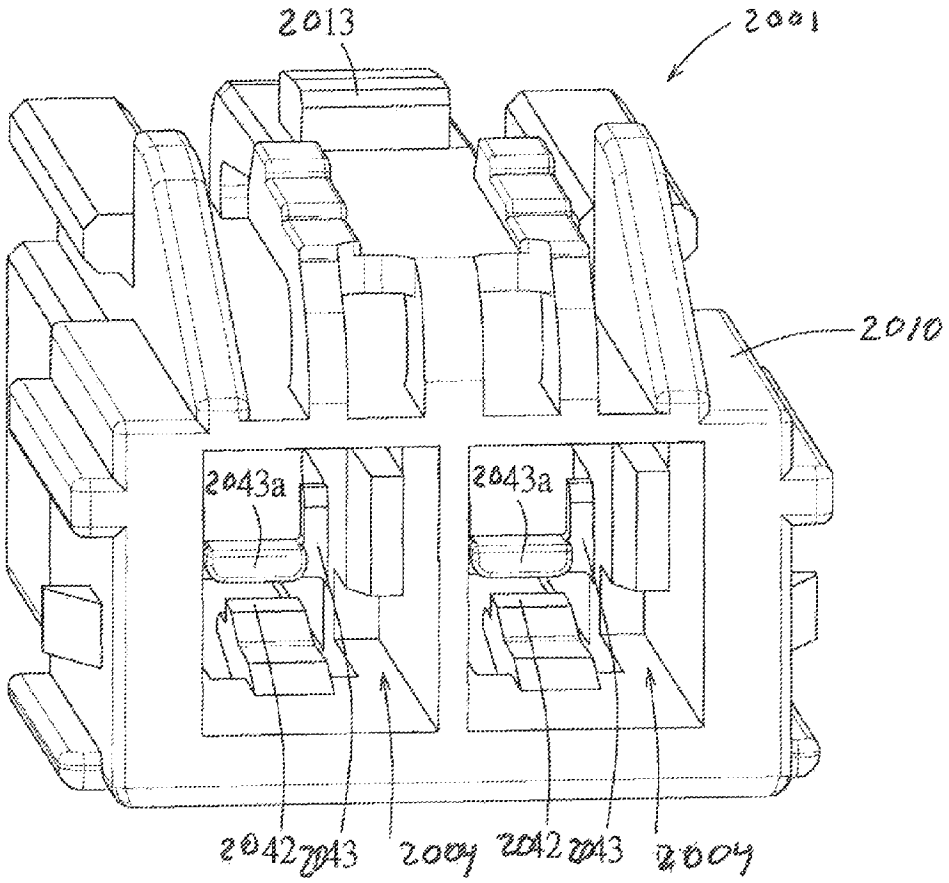
FIG. 31 is a perspective view illustrating a structure of the terminal groove of the first connector of the embodiment.
Figure 32:
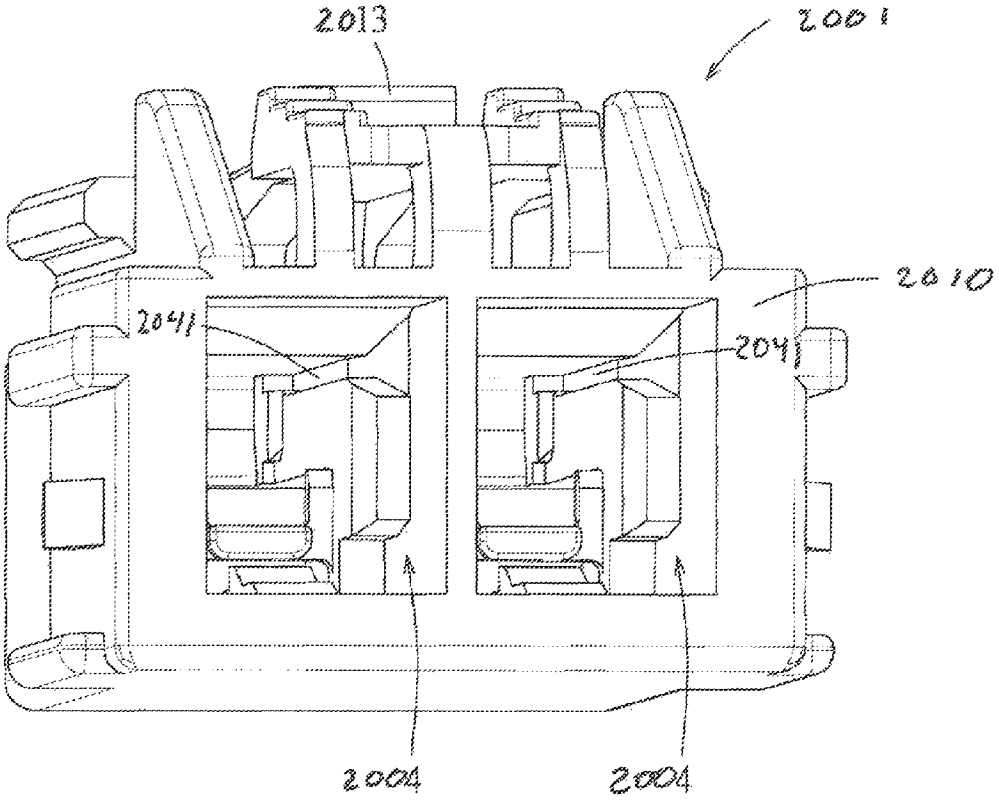
FIG. 32 is a view FIG. 31 viewed from another angle and illustrating a side groove portion in the terminal groove of the first connector of the embodiment.

Furthermore, as shown in FIG. 28 and FIG. 31, the two piece bodies 2241*a* cooperate with each other to form a U-shape structure, so as to allow the two piece bodies 2241*a* of the positioning portion 2241 to sheath onto the stopping protrusion 2043*a* by that the stopping protrusion 2043*a* is inserted into an inside space surrounded by the two piece bodies 2241*a* of the positioning portion 2241, in turn allow the two piece bodies 2241*a* to be limited between the elastic finger portion 2042 and the stopping block 2043. Moreover, as shown FIG. 33, when the conductive terminal 2002 is inserted into the terminal groove 2004, because the two guide portions 2232*b* substantially cover the two connecting portions 2222 respectively, it may prevent the two connecting portions 2222 from directly hitting an inside wall surface of the first mating portion 2011 during assembling.

Figure 33:
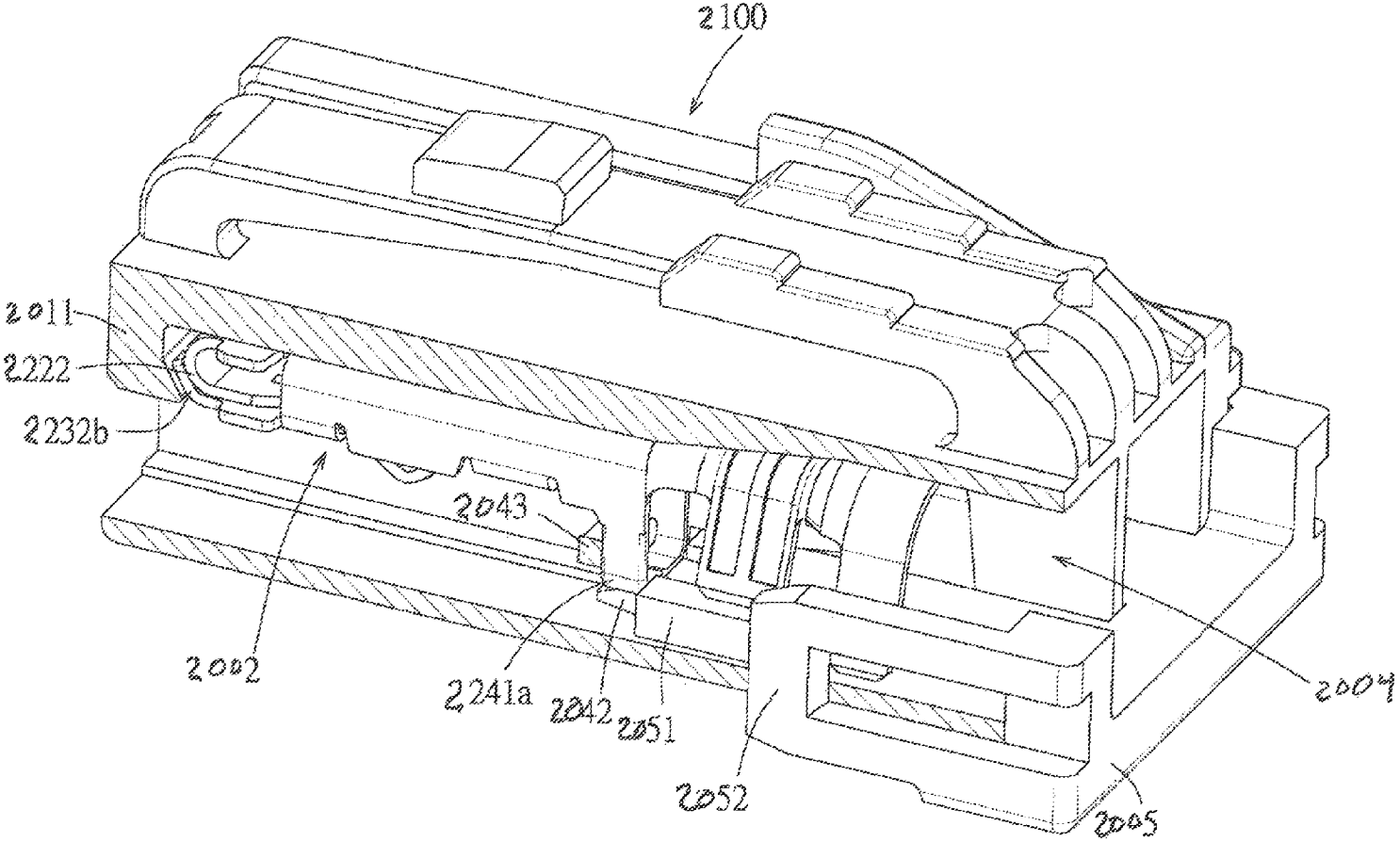
FIG. 33 is a perspective view partially sectioned and illustrating that the conductive terminal of the first connector of the embodiment is provided in the terminal groove and illustrating a functional relationship among the terminal groove, the conductive terminal and a first terminal holding member.
Figure 34:
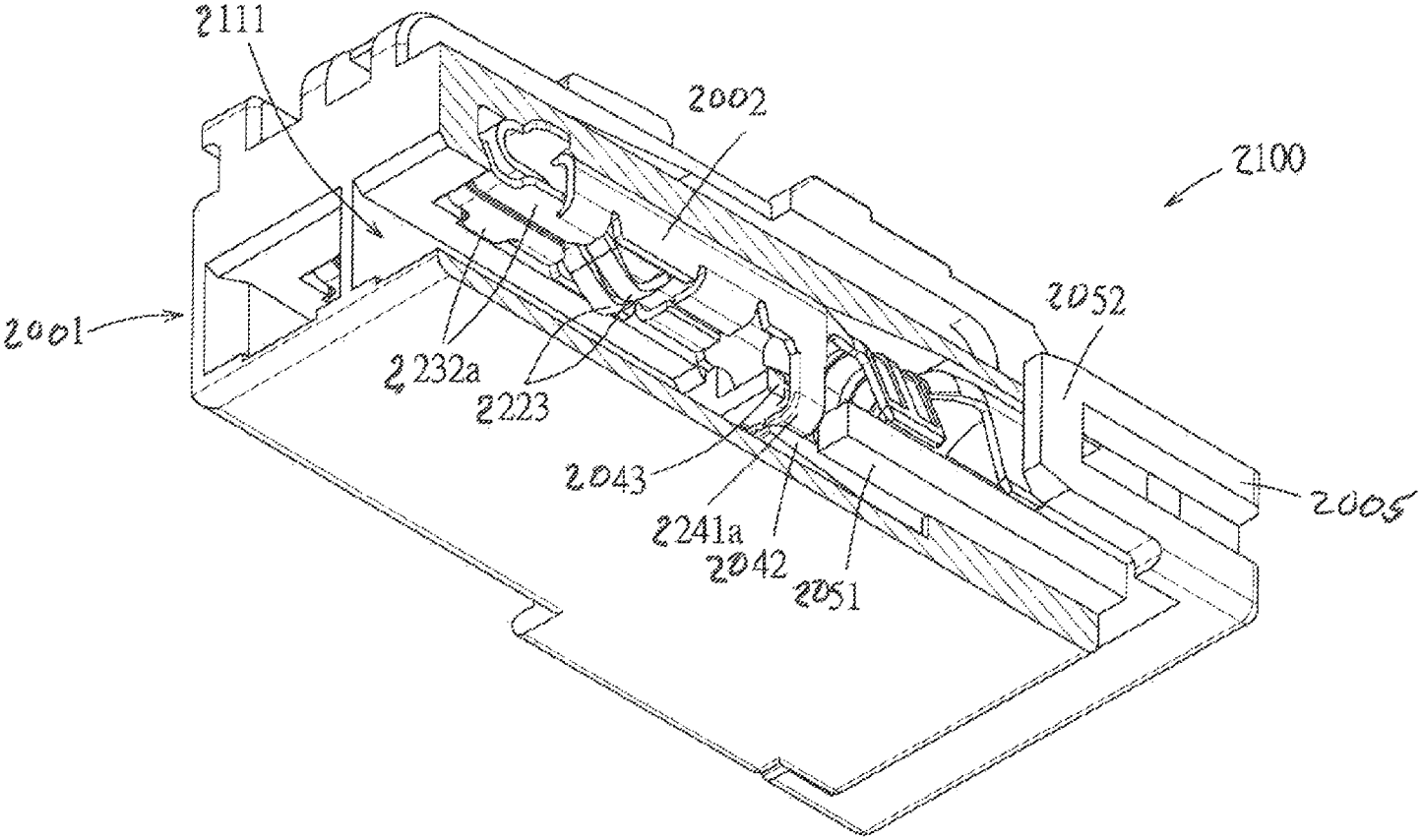
FIG. 34 is a view of FIG. 33 viewed from another angle.

Referring to FIG. 33 and FIG. 34, the first terminal holding member 2005 is engaged with the first mounting portion 2012 (see FIG. 24 and FIG. 27) and has a plurality of positioning pieces 2051 respectively entering into the plurality of terminal groove 2004, a front end of each positioning piece 2051 is formed with a recessed groove 2511, when the first terminal holding member 2005 is assembled to the first mounting portion 2012, the recessed groove 2511 of each positioning piece 2051 can allow each positioning piece 2051 to avoid the elastic finger portion 2042 in the corresponding terminal groove 2004, and a front end of the positioning piece 2051 is positioned on two rear ends of the two piece bodies 2241*a* of the positioning portion 2241 of the corresponding conductive terminal 2002, so that the positioning piece 2051 and the corresponding stopping block 2043 cooperatively interpose and position the two piece bodies 2241*a* of the conductive terminal 2002, in turn fixation of the conductive terminal 2002 is strengthened.

Referring to FIG. 24 to FIG. 27, specifically, the first terminal holding member 2005 further has two elastic latch frames 2052 respectively positioned at two sides of the plurality of positioning pieces 2051 and face each other. The first insulating housing 2001 further has two first positioning blocks 2015 respectively corresponding to the two elastic latch frames 2052 and each having a wedge-shape. Before the first terminal holding member 2005 is assembled to the first insulating housing 2001, an oblique surface 2151 of the first positioning block 2015 faces the corresponding elastic latch frame 2052, so that when the elastic latch frame 2052 is assembled to the first insulating housing 2001, the elastic latch frame 2052 easily slides over and passes through the first positioning block 2015, when the elastic latch frame 2052 reaches a preset position, the first positioning block 2015 enters into the elastic latch frame 2052, an upright surface 2152 of the first positioning block 2015 stops the elastic latch frame 2052 to reversely move, so as to allow the first terminal holding member 2005 to be engaged with and fixed to the first insulating housing 2001. Referring to FIG. 34, when the conductive terminal 2002 is provided in the first insulating housing 2001, the first contact portion 2223 protrudes into the corresponding first insertion slot 2111 and the second contact portion 2232*a* is exposed to the corresponding first insertion slot 2111.

Figure 35:
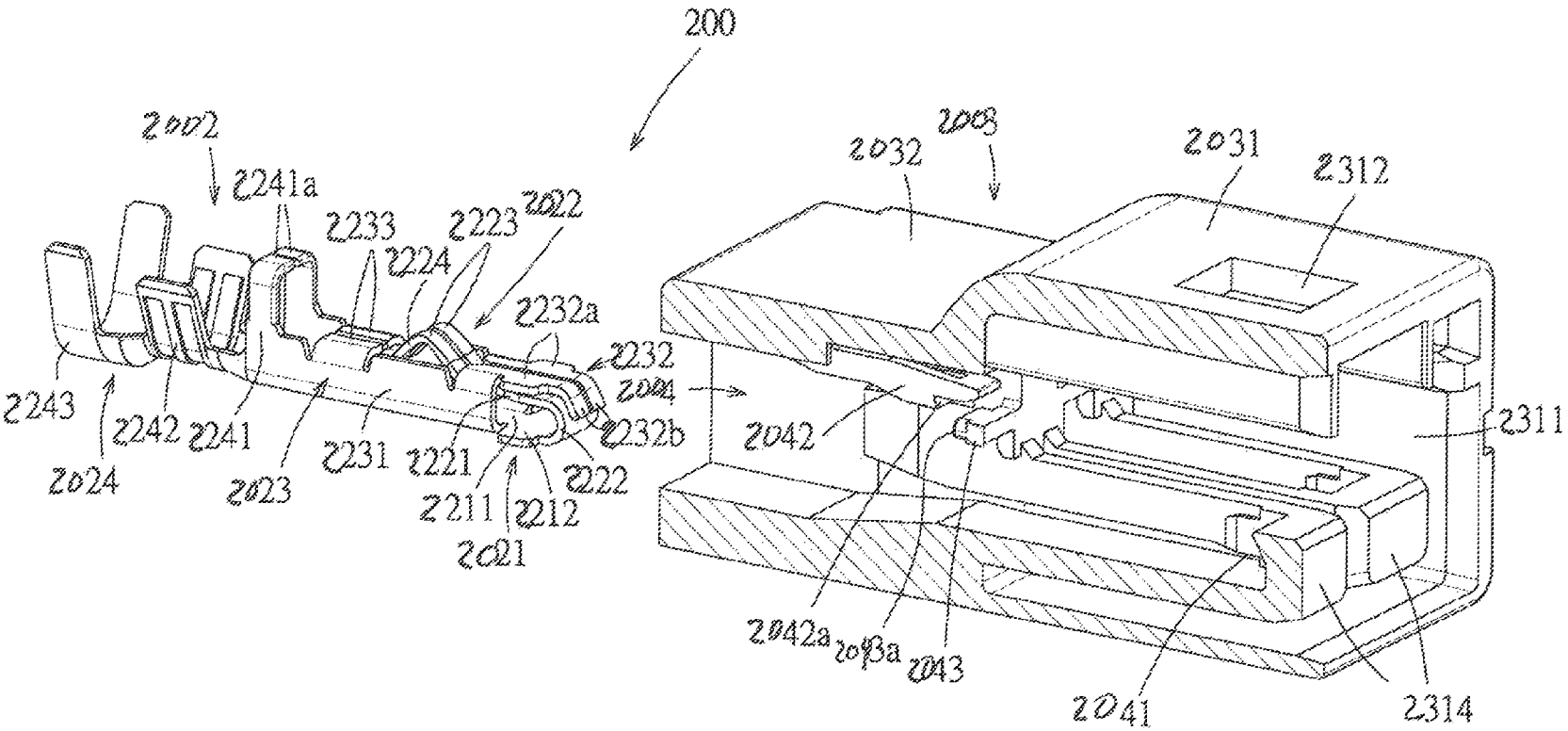
FIG. 35 is an exploded perspective view partially sectioned and illustrating a corresponding relationship between a terminal groove and a conductive terminal of the second connector of the embodiment in structure.
Figure 36:
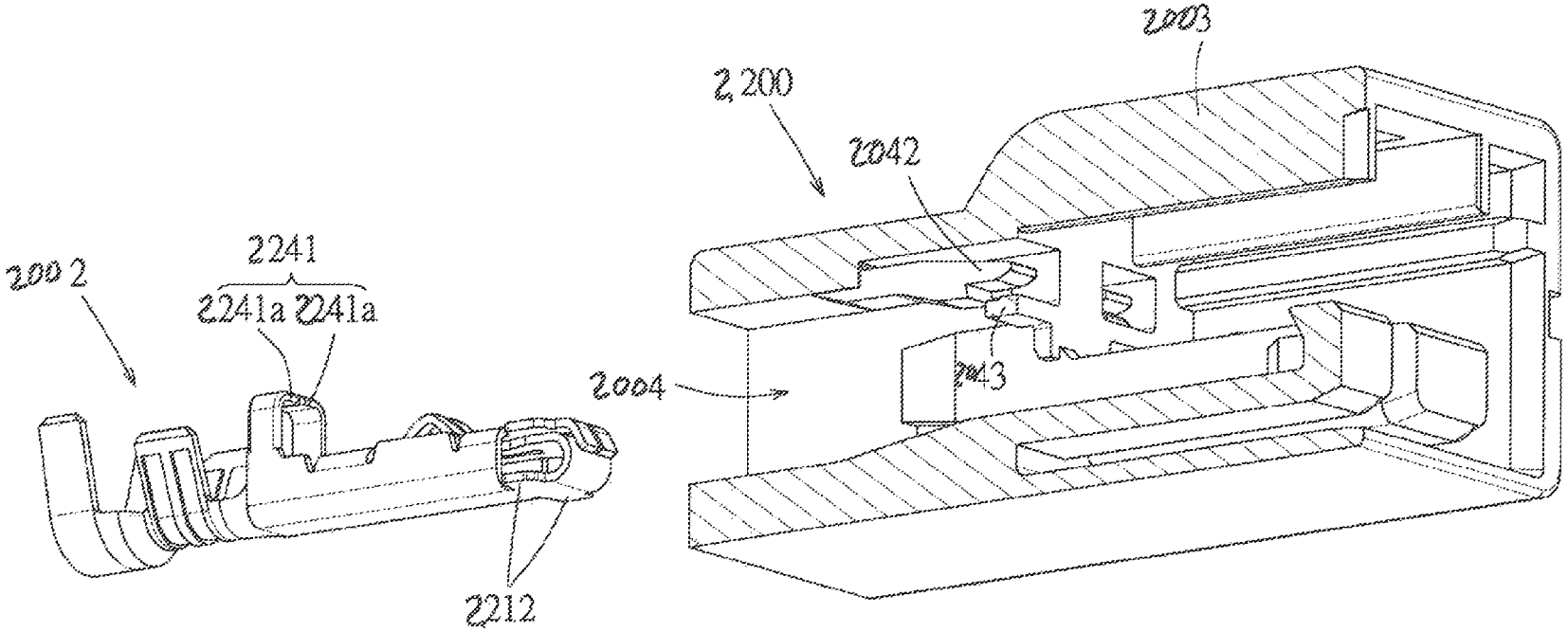
FIG. 36 is a view of FIG. 35 viewed from another angle.
Figure 37:
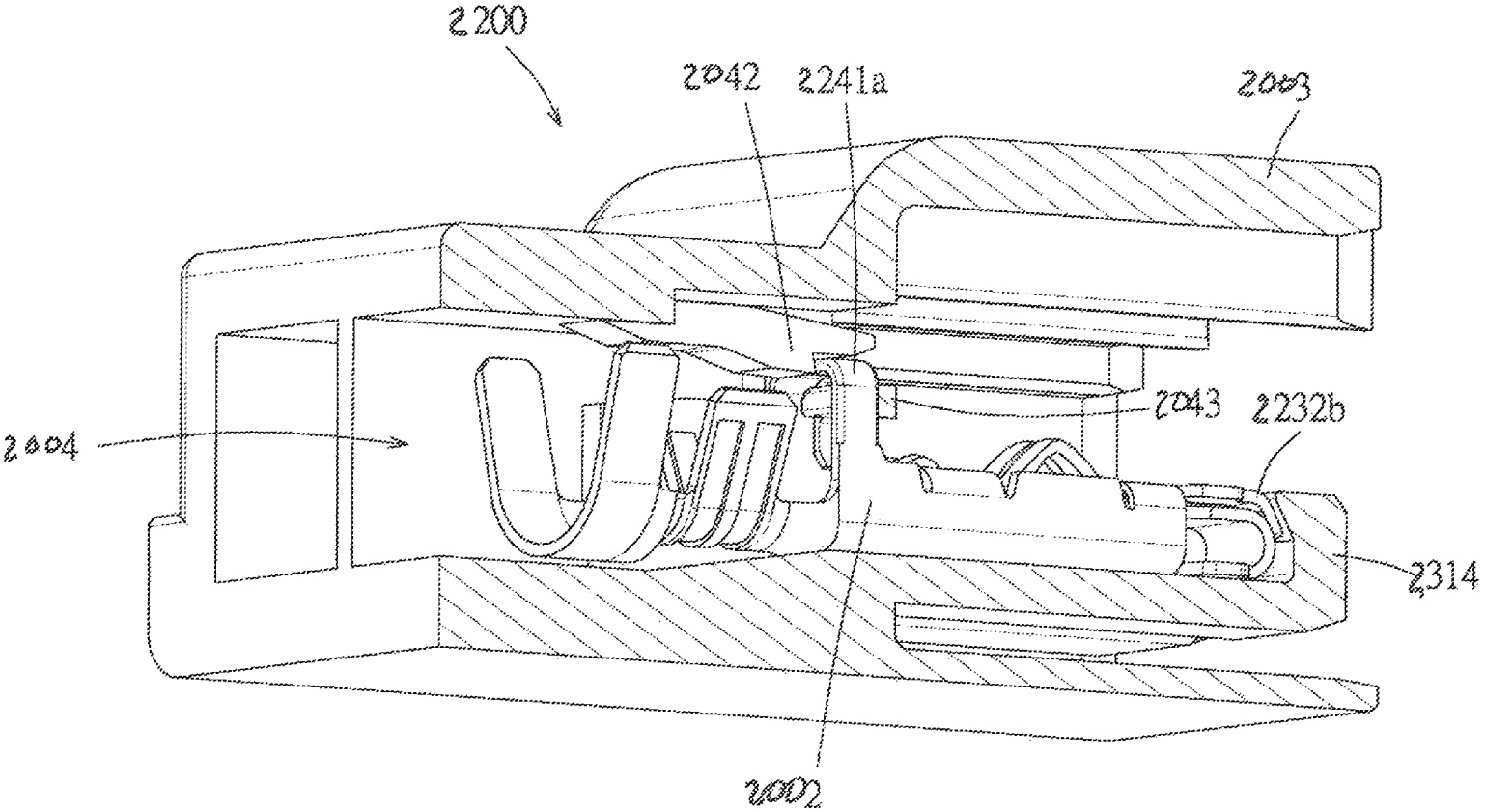
FIG. 37 is a perspective view partially sectioned and illustrating the conductive terminal is provided in the terminal groove in the second connector of the embodiment.

Referring to FIG. 35, FIG. 36 and FIG. 37, the second insulating housing 2003 has a second mating portion 2031, a second mounting portion 2032 integrally connected with the second mating portion 2031, and a plurality of terminal grooves 2004. The second mating portion 2031 is used to mate with the first mating portion 2011, and has a second insertion slot 2311 and a plurality of protruding blocks 2314 each protruding into the second insertion slot 2311, the plurality of protruding blocks 2314 are respectively received in the plurality of first insertion slots 2111. The plurality of terminal grooves 2004 of the second insulating housing 2003 each extend from the second mounting portion 2032 to the corresponding protruding block 2314 and are communicated with the second insertion slot 2311.

Figure 38:
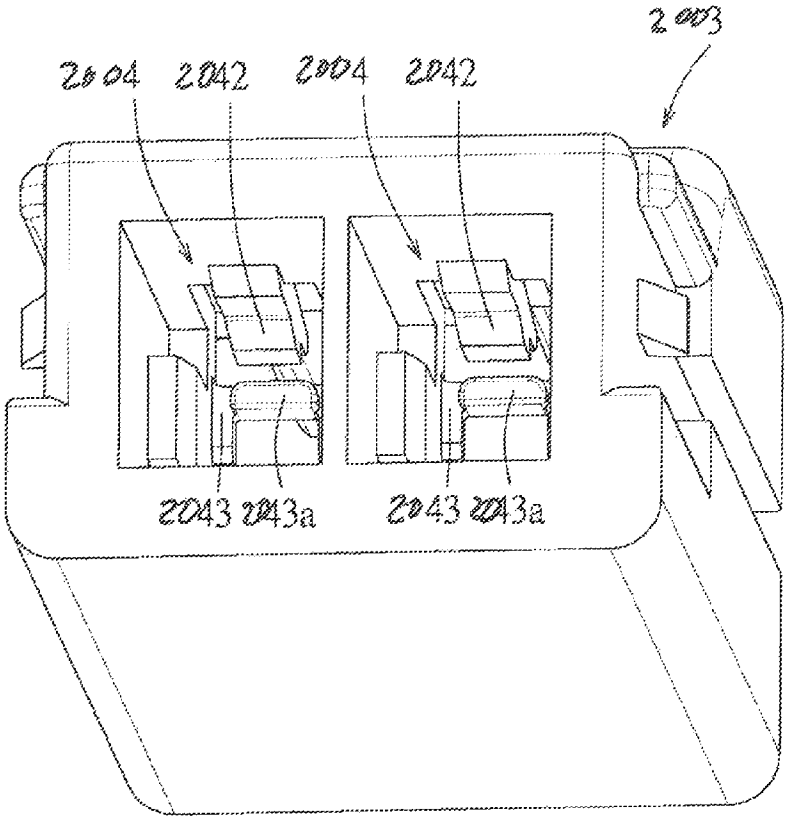
FIG. 38 is a perspective view illustrating a structure of the terminal groove of the second connector of the embodiment.
Figure 39:
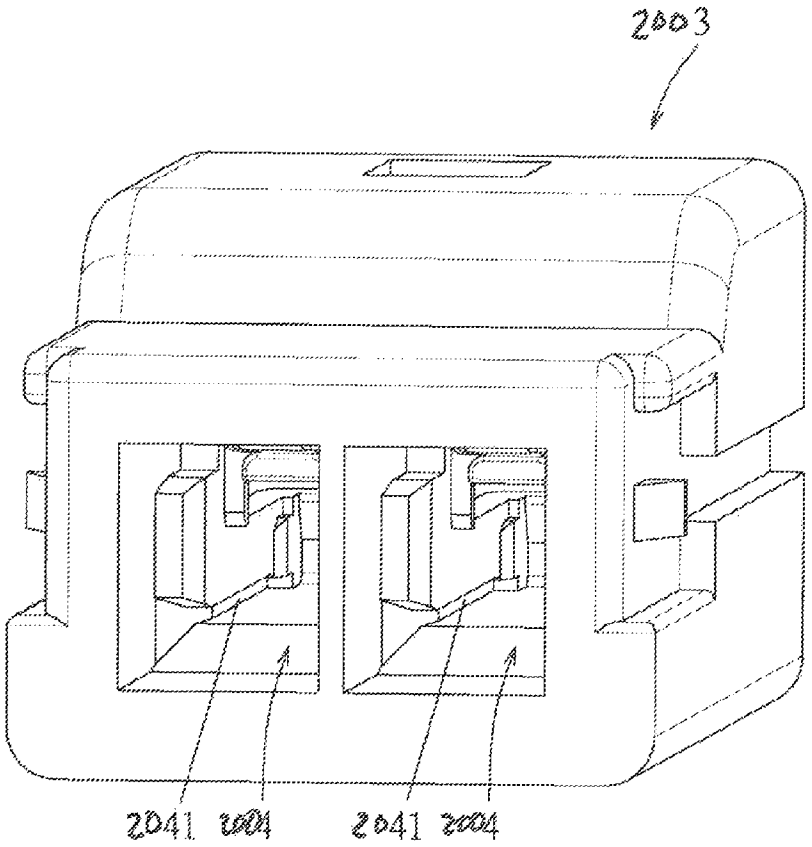
FIG. 39 is a view of FIG. 38 viewed from another angle and illustrating a side groove portion in the terminal groove of the second connector of the embodiment.

In combination with referring to FIG. 38 and FIG. 39, a structure inside the terminal groove 2004 of the second insulating housing 2003 is substantially identical to the structure inside the terminal groove 2004 of the first insulating housing 2001, and provision of the conductive terminal 2002 of the second connector 2200 in the terminal groove 2004 of the second insulating housing 2003 is also identical to the provision of the conductive terminal 2002 of the first connector 2100 in the terminal groove 2004 of the first insulating housing 2001, only difference lies in that the conductive terminal 2002 of the second connector 2200 is rotated by 180 degrees relative to the conductive terminal 2002 of the first connector 2100, so that the conductive terminal 2002 of the first connector 2100 and the conductive terminal 2002 of the second connector 2200 can be mated with each other, accordingly, the structure inside the terminal groove 2004 of the second insulating housing 2003 is rotated by 180 degrees relative to the structure inside the terminal groove 2004 of the first insulating housing 2001, therefore detailed description on the structure inside the terminal groove 2004 of the second insulating housing 2003 is omitted.

Figure 40:
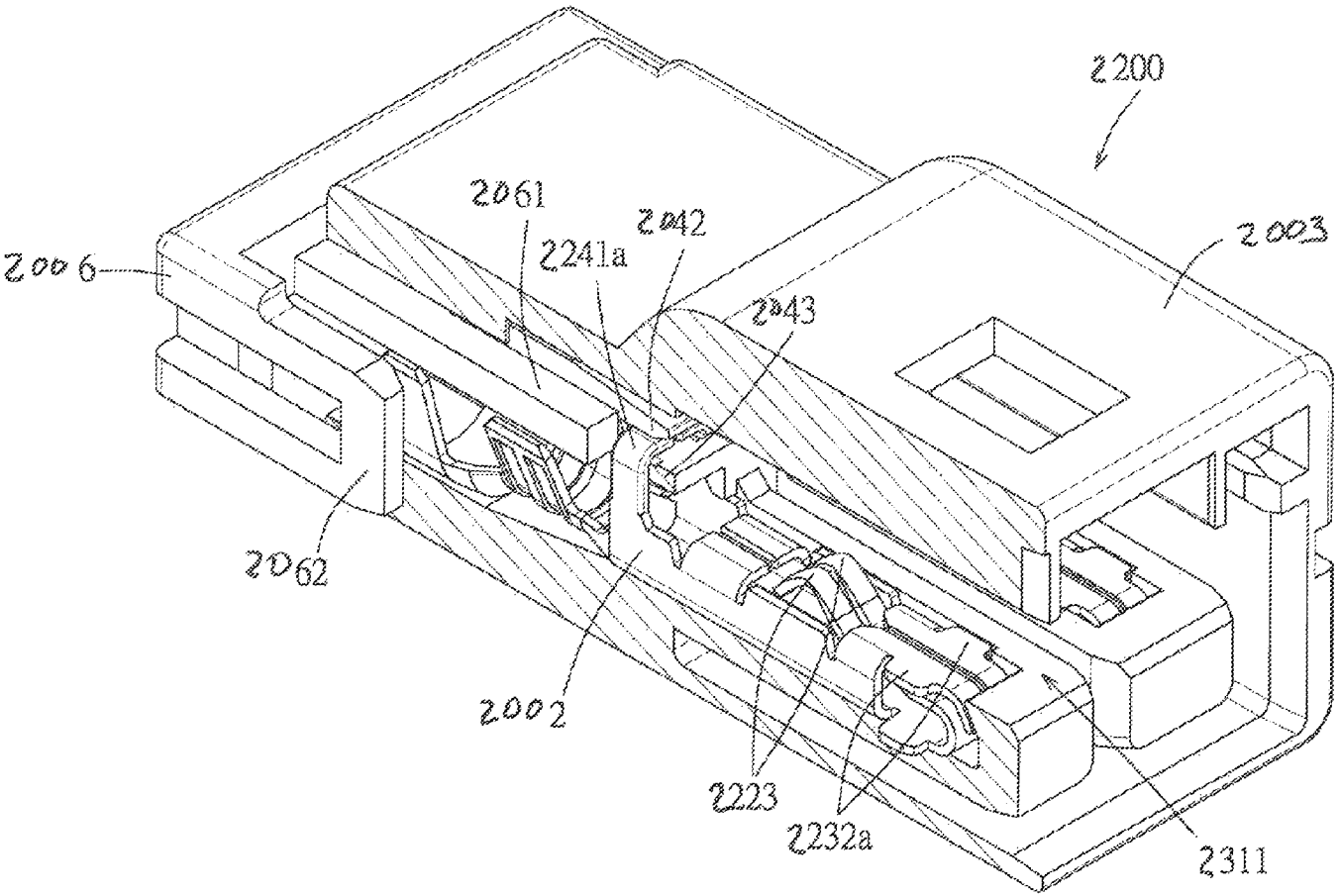
FIG. 40 is a perspective view partially sectioned and illustrating the conductive terminal is provided in the terminal groove in the second connector of the embodiment and illustrating a functional relationship among the terminal groove, the conductive terminal and a second terminal holding member.
Figure 41:
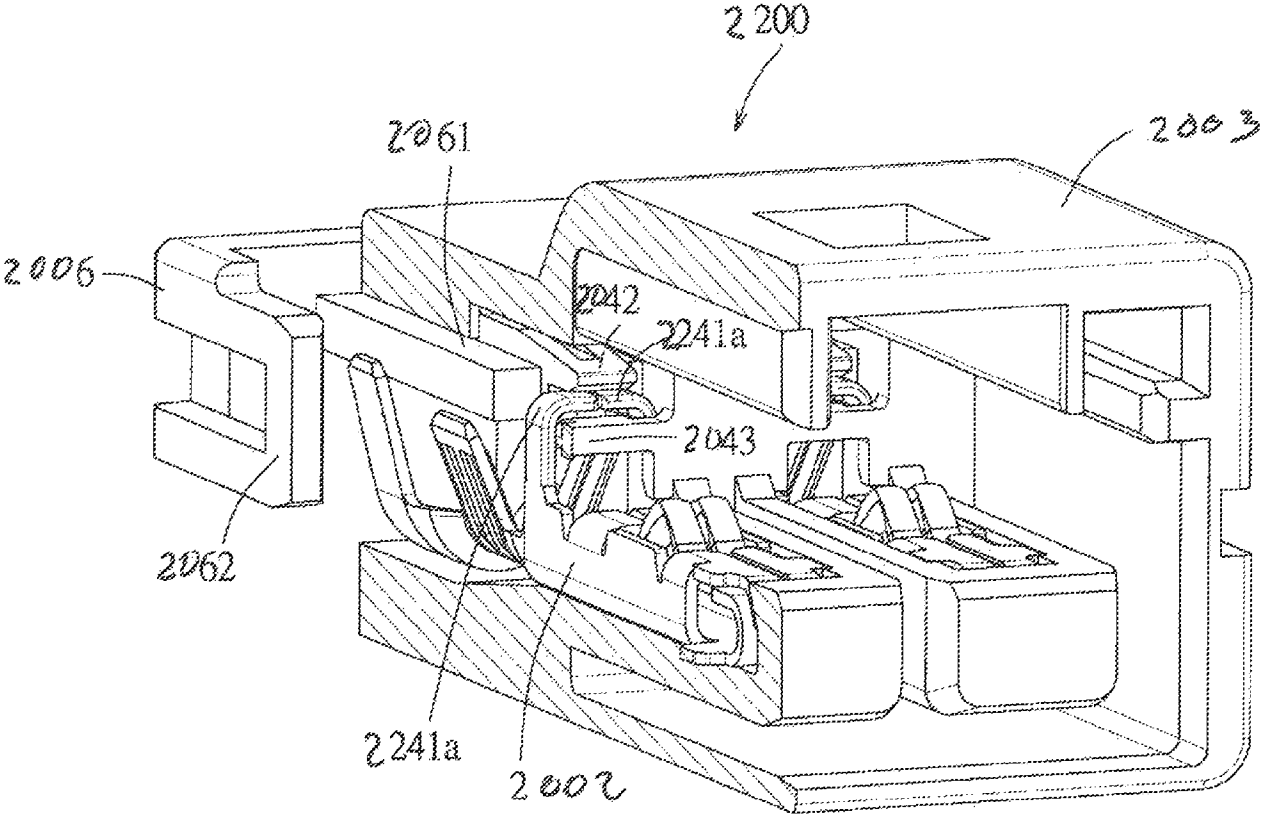
FIG. 41 is a view of FIG. 40 viewed from another angle.
Figure 42:
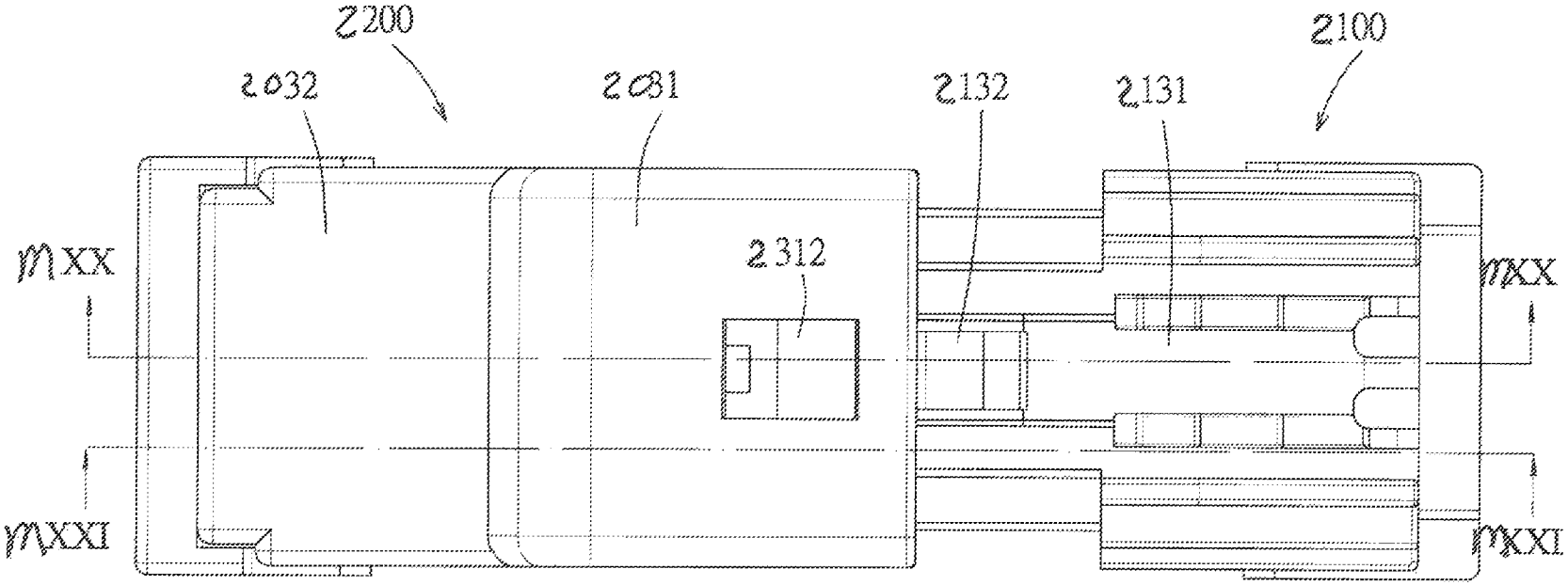
FIG. 42 is a top view illustrating a status that a latching block does not enter into an insertion slot when the first connector and the second connector of the embodiment are mated with each other.
Figure 43:
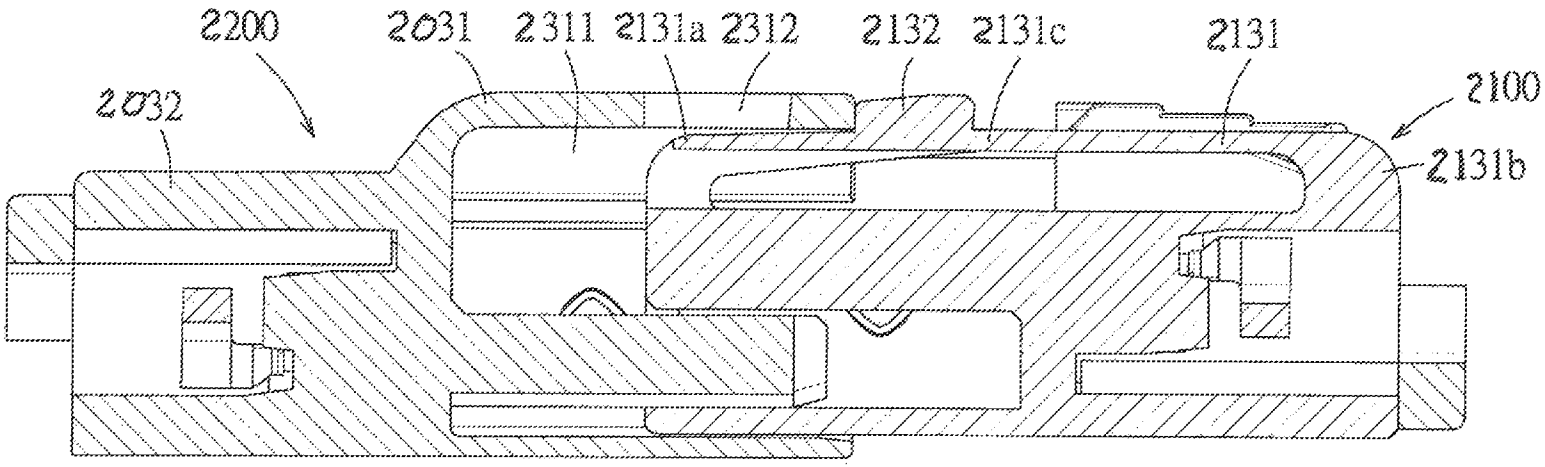
FIG. 43 is a cross sectional view taken along a line MXX-MXX of FIG. 42.
Figure 41:
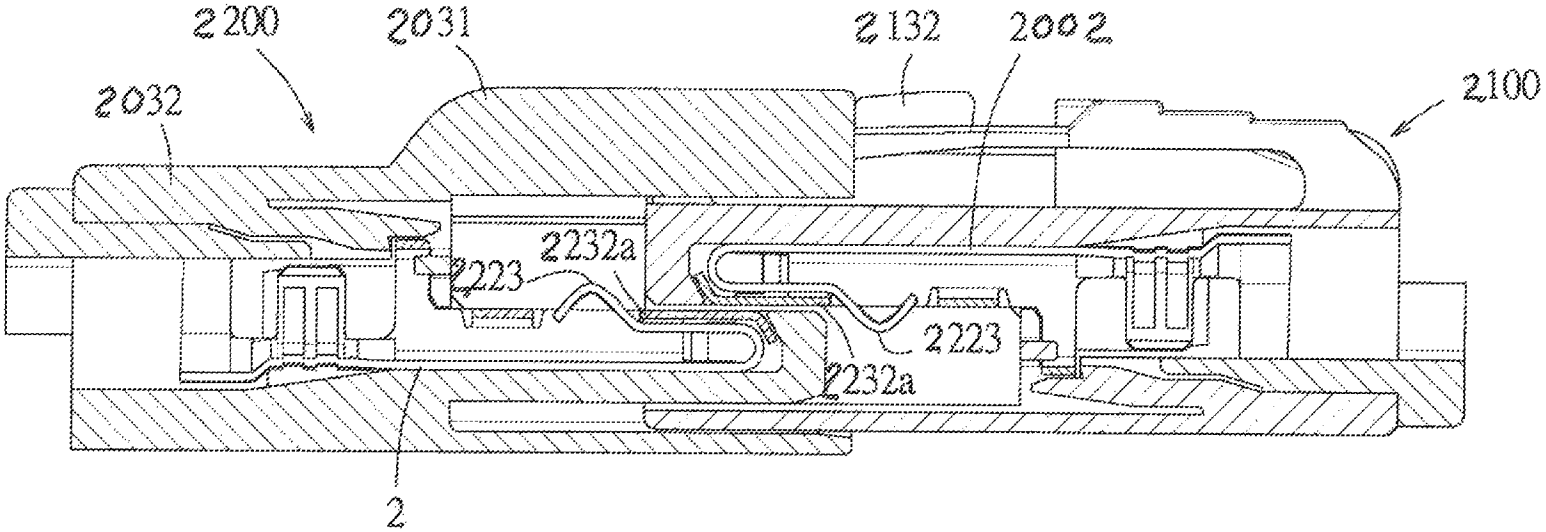

Referring to FIG. 40 and FIG. 41, when each conductive terminal 2002 is provided in the second insulating housing 2003, the first contact portion 2223 protrudes into the corresponding second insertion slot 2311 and the second contact portion 2232*a* is exposed to the corresponding second insertion slot 2311. Similarly, the second connector 2200 further comprises a second terminal holding member 2006, the second terminal holding member 2006 is engaged with the second mounting portion 2032 and has a plurality of positioning pieces 2061 respectively entering into the plurality of terminal grooves 2004, a front end of each positioning piece 2061 is formed with a recessed groove 2611, when the second terminal holding member 2006 is assembled to the second mounting portion 2032, the recessed groove 2611 of each positioning piece 2061 can allow each positioning piece 2061 to avoid the elastic finger portion 2042 in the corresponding terminal groove 2004, and a front end of the positioning piece 2061 abuts against two rear ends of the two piece bodies 2241*a* of the corresponding conductive terminal 2002, so that the positioning piece 2061 and the stopping block 2043 in the corresponding terminal groove 2004 cooperatively interpose and position the two piece bodies 2241*a* of the conductive terminal 2002.

Moreover, Referring to FIG. 24 to FIG. 27, the second terminal holding member 2006 further has two elastic latch frames 2062 respectively positioned at two sides of the plurality of positioning pieces 2061 and face each other. The second insulating housing 2003 further has two second positioning blocks 2033 respectively corresponding to the two elastic latch frames 2062 and each having a wedge-shape. A manner of the second terminal holding member 2006 assembled to the second insulating housing 2003 is identical to the manner of the first terminal holding member 2005 assembled to the first insulating housing 2001, so detail description is omitted.

Referring to FIG. 28 and FIG. 29, the locking portion 2013 of the first insulating housing 2001 has an elastic support member 2131 which extends along the front-rear direction F-R and is integrally connected to the top wall 2101 and a latching block 2132. The elastic support member 2131 has a first connecting section 2131*a* connected to the top wall 2101 and adjacent to the front side edge 2102, a second connecting section 2131*b* connected to the top wall 2101 and adjacent to the rear side edge 2103, and an elastic section 2131*c* positioned between the first connecting section 2131*a* and the second connecting section 2131*b* and spaced apart from the top wall 2101. By that the first connecting section 2131*a* and the second connecting section 2131*b* respectively positioned at two ends of the elastic support member 2131 are respectively connected to the top wall 2101 of the main body 2010, that is the elastic support member 2131 is closed at the two ends, so that the elastic support member 2131 is not easily broken due to pulling. The latching block 2132 is provided on the elastic section 2131*c*. In combination with referring to FIG. 35, the second insertion slot 2311 of the second insulating housing 2003 receives the first mating portion 2011 and a part of the locking portion 2013, and the second mating portion 2031 further has a latching groove 2312 receiving the latching block 2132, the latching groove 2312 is communicated with the second insertion slot 2311.

Figure 24:
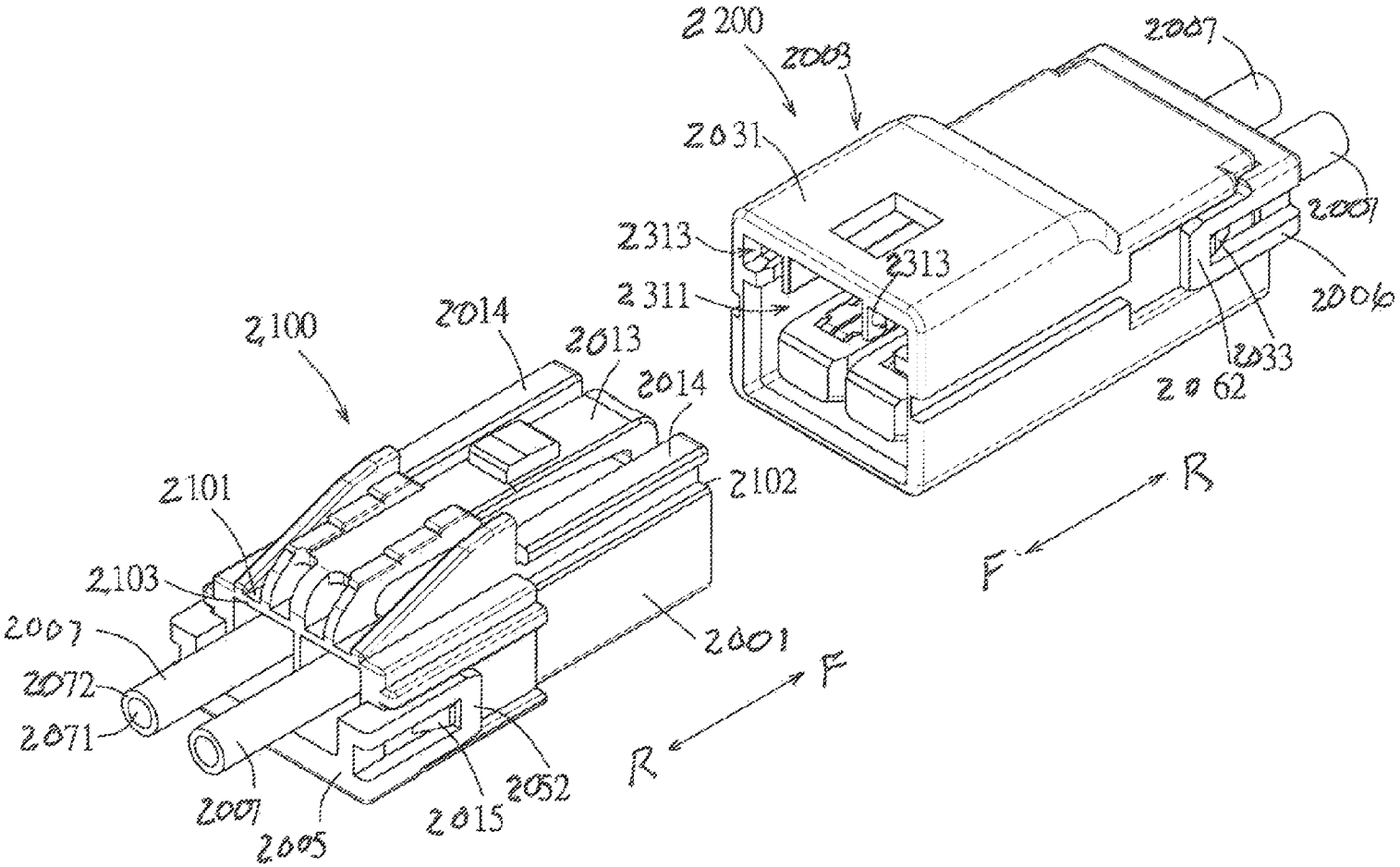
FIG. 24 is a is an exploded perspective view illustrating another embodiment of an electrical connector assembly of the present disclosure with a first connector and a second connector unmated with each other.
Figure 25:
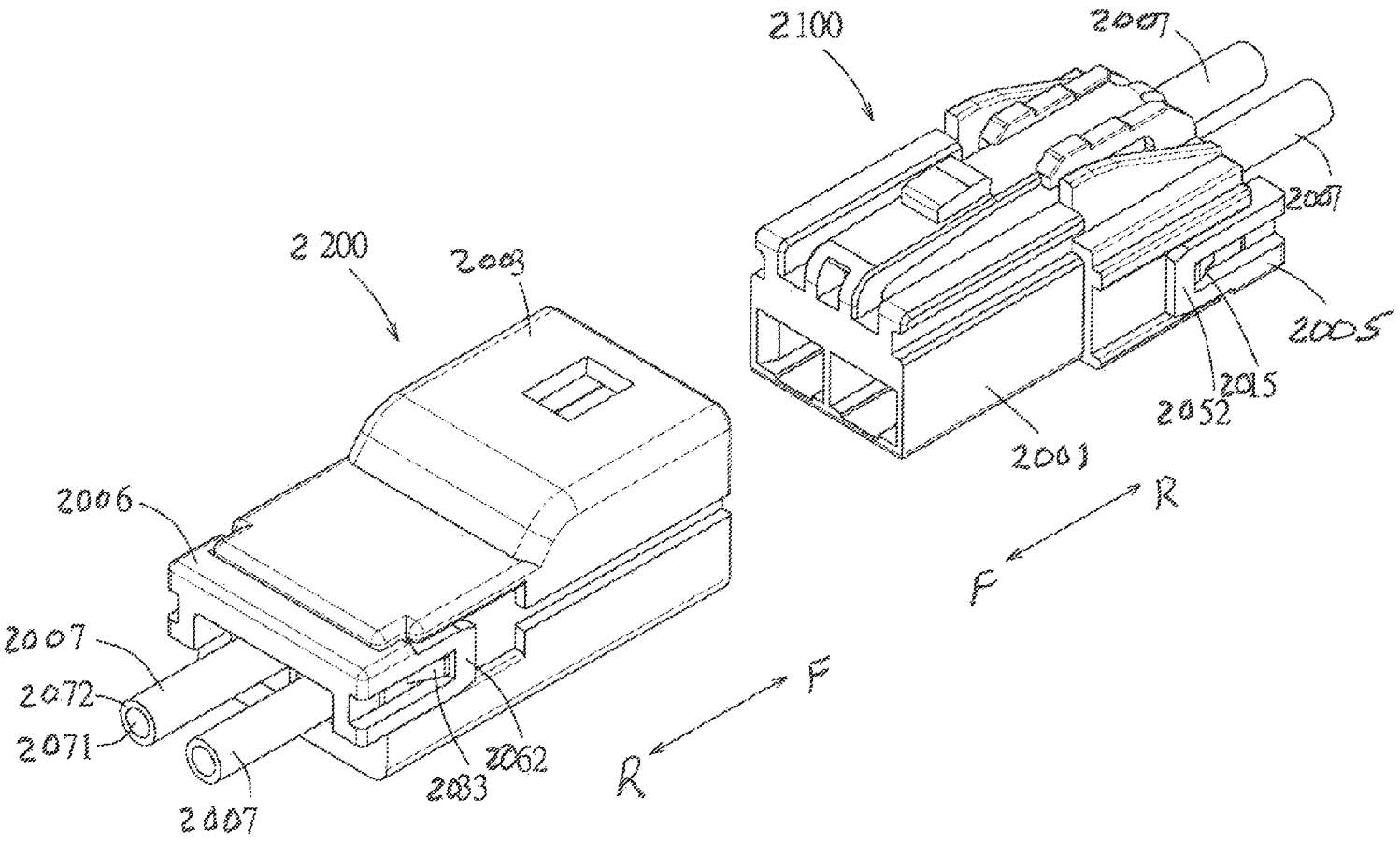
FIG. 25 is a view of FIG. 24 viewed from another angle.
Figure 48:
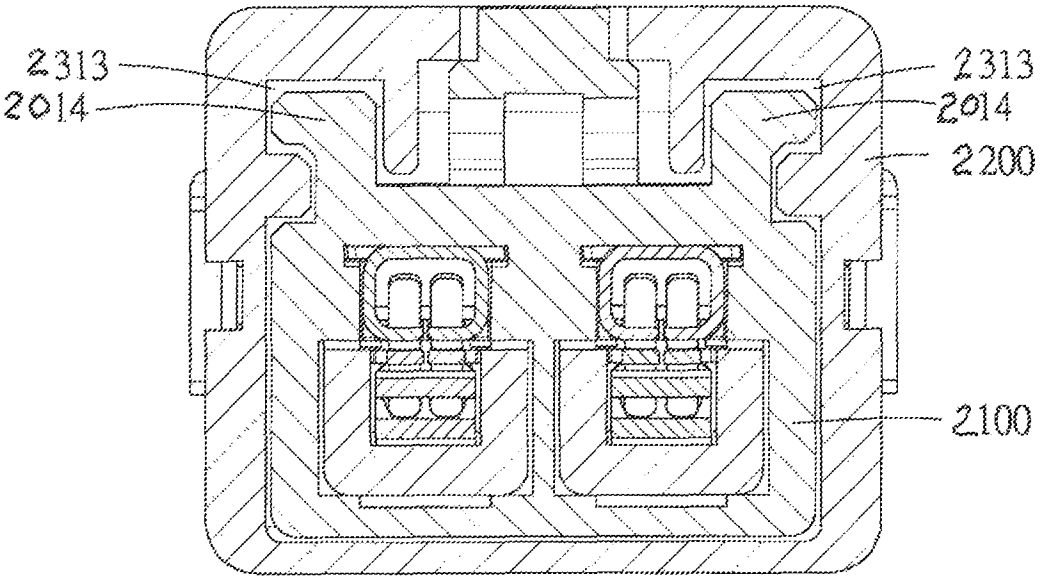
FIG. 48 is a cross sectional view taken along a line MXXV-MXXV of FIG. 45 and illustrating a functional relationship between a key of the first connector and a key groove of the second connector in the embodiment.

Moreover, in combination with referring to FIG. 24 and FIG. 48, the first insulating housing 2001 further has two keys 2014 respectively positioned at two sides of the locking portion 2013 and parallel to the front-rear direction F-R, the two keys 2014 are respectively connected to the top wall 2101 and each extend rearwardly from the front side edge 2102 along the front-rear direction F-R. The second mating portion 2031 of the second insulating housing 2003 further has two key grooves 2313 respectively receiving the two keys 2014, and the two keys grooves 2313 are communicated with the second insertion slot 2311. That the two keys 2014 are respectively engaged with the two key grooves 2313 may prevent the first mating portion 2011 of the first connector 2100 from being improperly inserted into the second insertion slot 2311 of the second connector 2200. Moreover, the two keys 2014 may have different cross sectional profiles, the cross sectional profiles of the two keys 2014 may be adjusted and the corresponding key grooves 2313 may be also correspondingly adjusted, so that different electrical connector assemblies each have the keys 2014 and the key grooves 2313 which have different cross sectional profiles, and thus it may prevent different electrical connector assemblies from being improperly assembled therebetween with respect to a system having a plurality of electrical connector assemblies.

Referring to FIG. 42, FIG. 43, FIG. 44 and FIG. 48, during mating of the first connector 2100 and the second connector 2200, only the two keys 2014 of the first connector 2100 respectively correspond to the two keys grooves 2313 of the second connector 2200 in position and profile, can the first mating portion 2011 enter into the second insertion slot 2311; then, the latching block 2132 of the first connector 2100 is pressed down so as to enter into the second insertion slot 2311, the latching block 2132 is allowed to slide relative to the second insulating housing 2003 and in turn move and enter into the latching groove 2312, so that locking between the first connector 2100 and the second connector 2200 is completed. It should be specifically noted that, in combination with referring to FIG. 33 and FIG. 37, during the mating of the first connector 2100 and the second connector 2200, taking the first connector 2100 as an example, because two front ends of the two second contact portions 2232*a* of each conductive terminal 2002 are spaced apart from the inside wall surface of the first mating portion 2011 by a certain distance, however, the two guide portions 2232*b* are respectively bent forwardly and obliquely from the two second contact portions 2232*a*, and so does the second connector 2200 in structure, therefore every two mated conductive terminal 2002 can slide along the guide portions 2232*b* and cannot be blocked during assembling.

Figure 45:
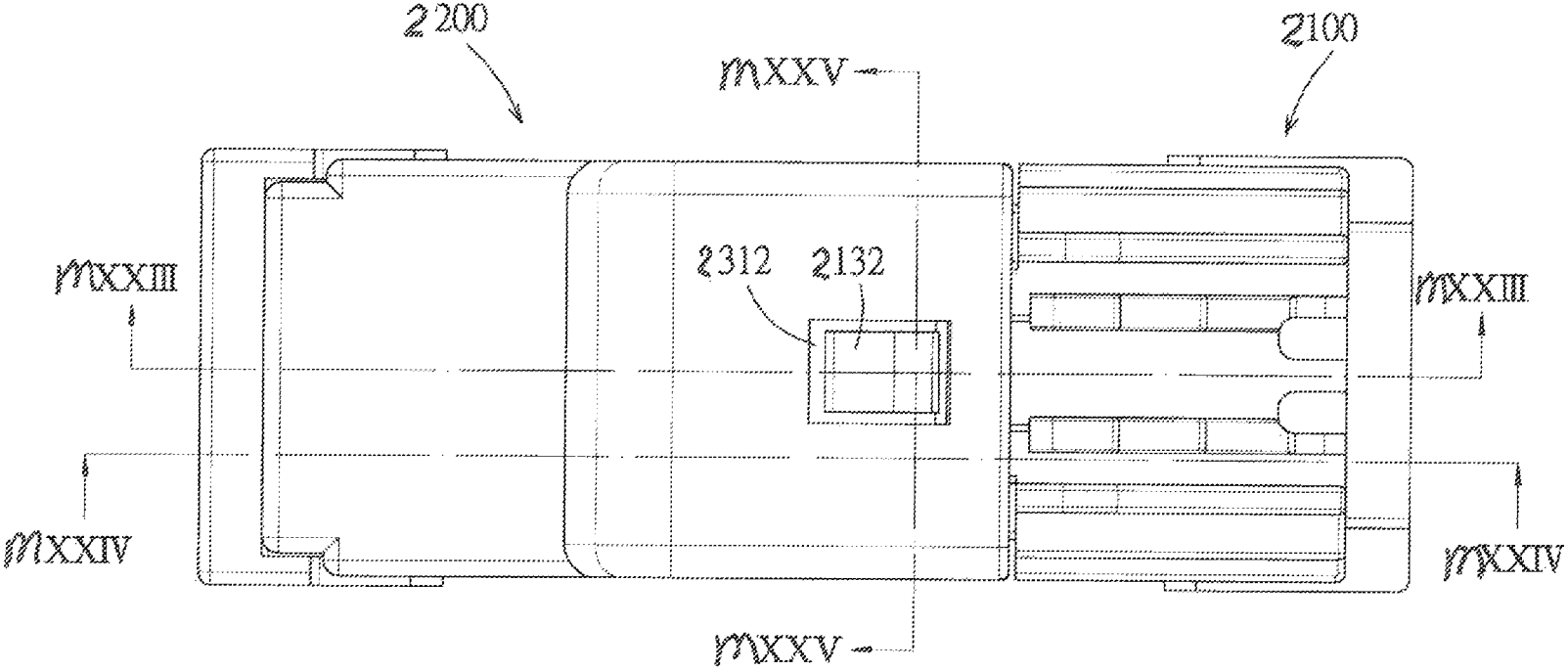
FIG. 45 is a top view illustrating a status that the first connector and the second connector of the embodiment have been mated with each other.
Figure 46:
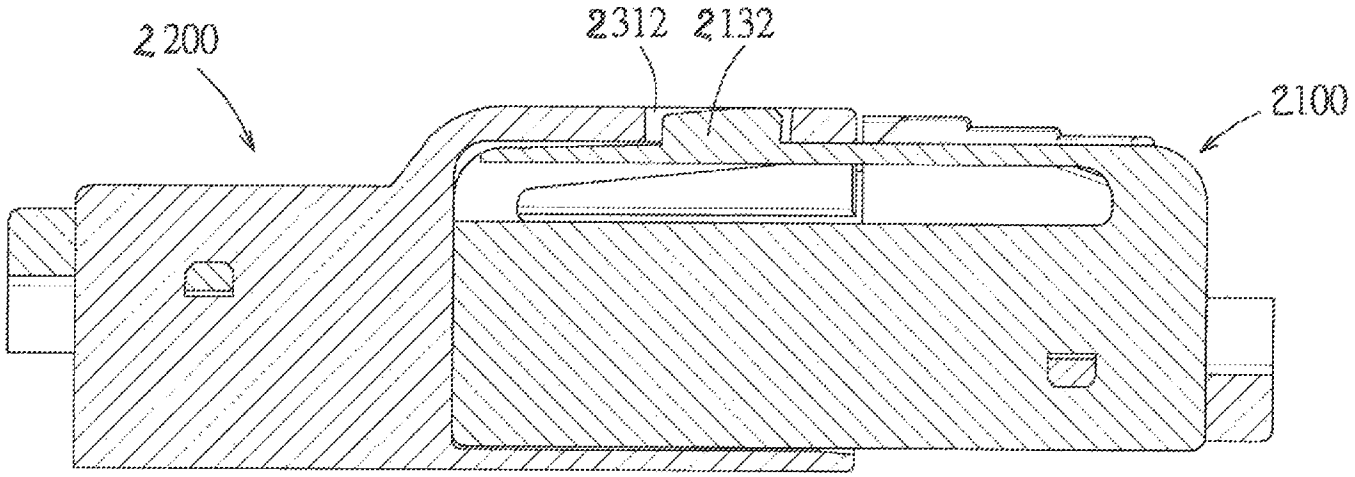
FIG. 46 is a cross sectional view taken along a line MXXIII-MXXIII of FIG. 45 and illustrating that the latching block has been positioned in a latching groove in the embodiment.
Figure 47:
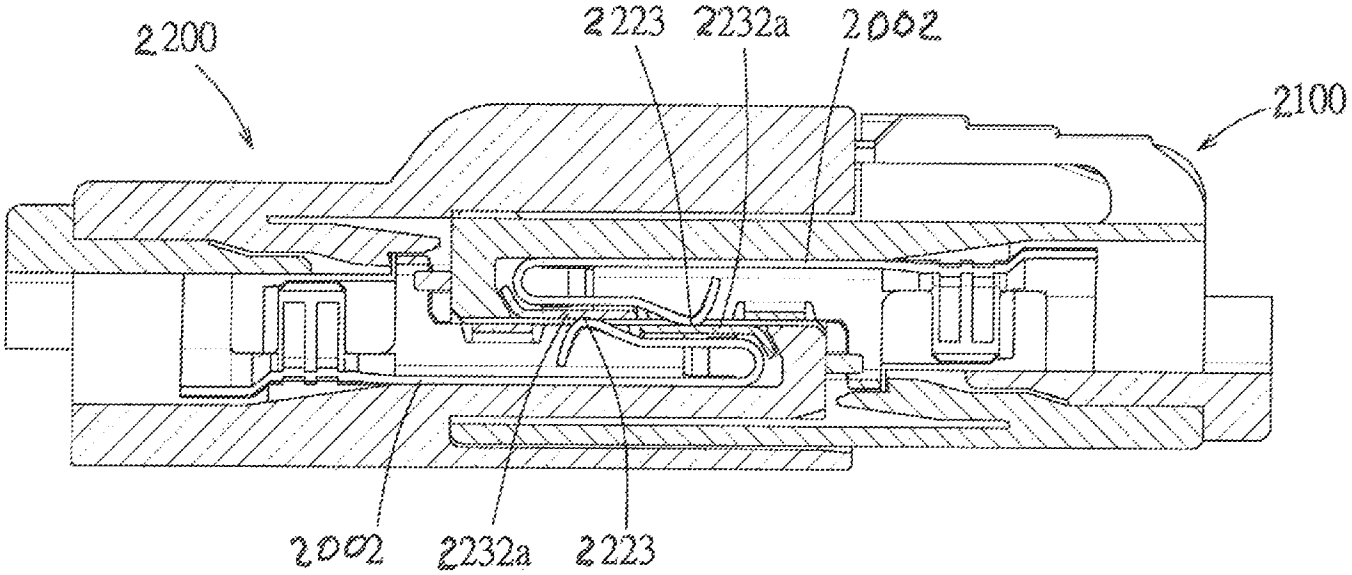
FIG. 47 is a cross sectional view taken along a line MXXIV-MXXIV of FIG. 45 and illustrating that the conductive terminal of the first connector and the conductive terminal of the second connector have been mated with each other to form four contacting regions in the embodiment.

Referring to FIG. 45, FIG. 46 and FIG. 47, when the mating between the first connector 2100 and the second connector 2200 has been completed, the latching block 2132 of the first connector 2100 has been positioned in the latching groove 2312 of the second connector 2200, so that the latching block 2132 is latched in the latching groove 2312 preventing the first connector 2100 from being withdrawn, and in turn allows the first connector 2100 and the second connector 2200 to be fixed relative to each other and be stably connected with each other. Moreover, as shown in FIG. 47, in every two mated conductive terminal 2002 between the first connector 2100 and the second connector 2200, the two first contact portions 2223 of one conductive terminal 2002 respectively contact the two second contact portions 2232*a* of the other conductive terminal 2002 and the two first contact portions 2223 of the other conductive terminal 2002 respectively contact the two second contact portions 2232*a* of the one conductive terminal 2002, so that four contacting regions are formed between every two mated conductive terminals 2002, which provides a more stable and more reliable electrical connection and can promote performance and stability under long-term use.

As with the previous embodiment, the conductive terminal 2002 of the first connector 2100 and the conductive terminal 2002 of the second connector 2200 are identical in structure and dimension, the conductive terminal 2002 of the first connector 2100 and the conductive terminal 2002 of the second connector 2200 may be manufactured with the same mold, not only manufacturing cost may be saved, but also the number and inventory of the components can be reduced.

In conclusion, as illustrated in the first embodiment, the conductive terminal 2 of the first connector 100 and the conductive terminal 2 of the second connector 200 are identical in structure and dimension, manufacturing cost may be saved; in every two mated conductive terminals 2, the elastic contacting portion 222 of one conductive terminal 2 contacts the plate-shaped contacting portion 221*a* of the other conductive terminal 2 and the elastic contacting portion 222 of the other conductive terminal 2 contacts the plate-shaped contacting portion 221*a* of the one conductive terminal 2, so that two contacting regions are formed between the every two mated conductive terminals 2, which provides a more stable and more reliable electrical connection and can promote performance and stability under long-term use. As illustrated in the second embodiment every two mated conductive terminals 2002 includes two first contact portions 2223 of one conductive terminal 2002 respectively contact two second contact portions 2232*a* of the other conductive terminal 2002 and the two first contact portions 2223 of the other conductive terminal 2002 respectively contact the two second contact portions 2232*a* of the one conductive terminal 2002, so that four contacting regions are formed between every two mated conductive terminals 2002, which provides a more stable and more reliable electrical connection and can promote performance and stability under long-term use.

The above described are only the embodiments, which cannot limit the scope of the implementation of the present disclosure, namely simple equivalent variations and modifications made according to the scope of the claims and content of the present disclosure are still fallen within the scope of the present disclosure.

The invention claimed is:

1. A conductive terminal, comprising:

a base unit, a contacting unit, a connecting piece and a tail unit, the base unit includes a plate portion extending along a front-rear direction, the contacting unit facing the plate portion and being spaced apart from the plate portion and having a plate-shaped contacting portion and an elastic contacting portion positioned behind the plate-shaped contacting portion, the connecting piece connecting a front end of the plate portion and a front end of the plate-shaped contacting portion, the tail unit being connected to a rear end of the plate portion.

2. The conductive terminal according to claim 1, wherein the contacting unit includes a plate body parallel to and spaced apart from the plate portion, the elastic contacting portion is formed from the plate body and a notch is formed along the separation location of the elastic contacting portion of the plate body.

3. The conductive terminal according to claim 2, wherein the plate body further includes an outer surface opposite to the plate portion, the elastic contacting portion having an elastic arm connected to the plate-shaped contacting portion and further including an extending section, the elastic arm extends along a front-rear direction and a distal end of the elastic arm projects from the outer surface of the plate body, the extending section is bent from the distal end of the elastic arm and extends rearwardly and obliquely, and a distal end of the extending section enters into the notch.

4. The conductive terminal according to claim 3, wherein the elastic arm includes a downward extending section which extends rearwardly and obliquely toward the plate portion through the notch and an upward extending section which extends rearwardly and obliquely from the downward extending section away from the plate portion, a connected location between the downward extending section and the upward extending section is positioned between the notch and the plate portion.

5. The conductive terminal according to claim 2, wherein the base unit further includes two side plate portions respectively bent from two sides of the plate portion, the two side plate portions respectively partially cover two side gaps defined between two side edges of the plate portion and two side edges of the plate body.

6. The conductive terminal according to claim 5, wherein the base unit further includes two wing portions extending respectively from two sides of the front end of the plate portion, the two wing portions are respectively positioned between the two side plate portions and the connecting piece.

7. The conductive terminal according to claim 1, wherein the base unit further includes a latching portion formed from the plate portion, the latching portion extends rearwardly along the front-rear direction and extends obliquely away from the plate body.

8. The conductive terminal according to claim 1, wherein the tail unit includes a positioning portion connected to the plate portion, a conductor fixing portion connected to the positioning portion and used to clamp and fix a part of a conductor of a cable without a corresponding insulating covering and an insulating covering fixing portion connected to the conductor fixing portion and used to clamp and fix a part of the cable with the corresponding insulating covering.

9. An electrical connector assembly, comprising:

a first connector and a second connector mated with the first connector, the first connector including a first insulating housing and a plurality of conductive terminals provided in the first insulating housing, the second connector including a second insulating housing and a plurality of conductive terminals provided in the second insulating housing;

each conductive terminal of the first connector and the second connector further includes: a base unit, a contacting unit, a connecting piece and a tail unit, the connecting piece connecting the base unit and the contacting unit, the base unit having a plate portion extending along a front-rear direction, the contacting unit facing the plate portion and being spaced apart from the plate portion and having a plate-shaped contacting portion and an elastic contacting portion positioned behind the plate-shaped contacting portion, the tail unit being connected to a rear end of the plate portion; and each conductive terminal of the first connector is used to respectively mate with a corresponding conductive terminal of the second connector, wherein the elastic contacting portion of one conductive terminal contacts the plate-shaped contacting portion of the other conductive terminal and the elastic contacting portion of the other conductive terminal contacts the plate-shaped contacting portion of the one conductive terminal.

10. The electrical connector assembly according to claim 9, wherein the contacting unit of each conductive terminal includes a plate body parallel to and spaced apart from the plate portion, the elastic contacting portion is formed from the plate body and a notch is formed along the separation location of the elastic contacting portion of the plate body.

11. The electrical connector assembly according to claim 10, wherein the plate body of each conductive terminal includes an outer surface opposite to the plate portion, the elastic contacting portion having an elastic arm connected to the plate-shaped contacting portion and further including an extending section, the elastic arm extends along a front-rear direction and a distal end of the elastic arm projects from the outer surface of the plate body, the extending section is bent from the distal end of the elastic arm and extends rearwardly and obliquely, and a distal end of the extending section enters into the notch.

12. The electrical connector assembly according to claim 11, the elastic arm of each conductive terminal includes a downward extending section which extends rearwardly and obliquely toward the plate portion through the notch and an upward extending section which extends rearwardly and obliquely from the downward extending section away from the plate portion a connected location between the downward extending section and the upward extending section is positioned between the notch and the plate portion.

13. The electrical connector assembly according to claim 10, the connecting piece of each conductive terminal connects a front end of the plate portion and a front end of the plate body, the base unit further includes two side plate portions respectively bent from two sides of the plate portion, the two side plate portions respectively partially cover two side gaps defined between two side edges of the plate portion and two side edges of the plate body.

14. The electrical connector assembly according to claim 13, the base unit of each conductive terminal further includes two wing portions extending respectively from two sides of the front end of the plate portion, the two wing portions are respectively positioned between the two side plate portions and the connecting piece.

15. The electrical connector assembly according to claim 10, the base unit of each conductive terminal further includes a latching portion formed from the plate portion, the latching portion extends rearwardly along the front-rear direction and extends obliquely away from the plate body.

16. The electrical connector assembly according to claim 15, wherein the tail unit of each conductive terminal includes a positioning portion connected to the plate portion, a conductor fixing portion connected to the positioning portion and used to clamp and fix a part of a conductor of a cable without a corresponding insulating covering and an insulating covering fixing portion connected to the conductor fixing portion and used to clamp and fix a part of the cable with the corresponding insulating covering.

17. The electrical connector assembly according to claim 16, wherein the first insulating housing has a first mating portion, a first mounting portion integrally connected with the first mating portion and a plurality of terminal grooves each penetrating the first mating portion and the first mounting portion;

the second insulating housing has a second mating portion, a second mounting portion integrally connected with the second mating portion and a plurality of terminal grooves each penetrating the second mating portion and the second mounting portion;

the second mating portion is used to mate with the first mating portion;

the plurality of terminal grooves of the first insulating housing respectively receive the plurality of conductive terminals of the first connector;

the plurality of terminal grooves of the second insulating housing respectively receive the plurality of conductive terminals of the second connector.

18. The electrical connector assembly according to claim 17, wherein each terminal groove further includes two side groove portions respectively configured to receive the two wing portions of the corresponding conductive terminal and a step portion configured to engage a latching portion of the conductive terminal.

19. The electrical connector assembly according to claim 18, wherein the first connector further includes a first terminal holding member, the second connector further includes a second terminal holding member;

each terminal groove is provided with a transverse wall and a protrusion protruding from the transverse wall;

a positioning portion is formed on each conductive terminal and includes a profile that is matched with a profile of the protrusion allowing the protrusion to be positioned in the positioning portion;

the first terminal holding member engages the first mounting portion and has a first positioning plate portion configured to enter the respective terminal groove of the first insulating housing, each first positioning plate portion and the transverse wall in the corresponding terminal groove cooperatively interpose and position the positioning portion of the corresponding conductive terminal of the first connector; and the second terminal holding member engages the second mounting portion and has a second positioning plate portion configured to enter the respective terminal groove of the second insulating housing, each second positioning plate portion and the transverse wall in the corresponding terminal groove cooperatively interpose and position the positioning portion of the corresponding conductive terminal of the second connector.

20. The electrical connector assembly according to claim 9, wherein the first insulating housing includes a main body and a locking portion, the main body has a first mating portion, a first mounting portion integrally connected with the first mating portion along a front-rear direction, and a top wall cooperatively formed by the first mating portion and the first mounting portion, the top wall, the locking portion has an elastic support member extending along the front-rear direction and integrally connected with the top wall and a latching block formed on the elastic support member; and the second insulating housing has a second mating portion and a second mounting portion integrally connected with the second mating portion along the front-rear direction, the second mating portion has an insertion slot configured for receiving the first mating portion and a part of the locking portion of the first insulating housing and a latching groove configured to engage the latching block.

21. A conductive terminal, comprising:

a base unit including a bottom plate extending along a front-rear direction and two side plates integrally extending upwardly from each side of the bottom plate respectively;

two elastic contact pieces arranged adjacent to each other, each elastic contact piece includes a connecting portion bent upwardly from a front end of the bottom plate, an arm portion extending rearwardly from the connecting portion, positioned above and spaced apart from the bottom plate, and a first contact portion positioned at a distal end of the arm portion;

a tail unit connected to a rear end of the bottom plate;

two contact plates respectively bent from the two side plates toward each other, each contact plate having a second contact portion and a guide portion positioned in front of the second contact portion, the second contact portion being positioned above the arm portion of the corresponding the elastic contact piece, the guide portion extending forwardly and downwardly and positioned above the connecting portion, and wherein the two first contact portions of the two elastic contact pieces extend upwardly respectively from two rear ends of the two contact plates and positioned respectively above the two second contact portions.

22. The conductive terminal according to claim 21, wherein the two side plates of the base unit respectively partially cover two side gaps defined between two side edges of the bottom plate and two side edges of the two arm portions of the two elastic contact pieces.

23. The conductive terminal according to claim 22, wherein each elastic contact piece further includes an extending portion, the extending portion bent from a rear end of the first contact portion and extending rearwardly and obliquely, and a distal end of the extending portion is positioned between the two side plates.

24. The conductive terminal according to claim 23, wherein the conductive terminal further includes two protect plates respectively bent from two upper edges of the two side plates and extend toward each other, the two protect plates are respectively positioned adjacent the two extending portions of the two elastic contact pieces.

25. The conductive terminal according to claim 21, wherein the bottom plate includes a plate portion and two wing portions respectively extending from two sides of a front end of the plate portion, and the two wing portions respectively positioned between the two side plates and the connecting portion.

26. The conductive terminal according to claim 25, wherein the tail unit along the front-rear direction includes a positioning portion connected to the plate portion, a conductor fixing portion connected to the positioning portion and used to clamp and fix a part of a conductor of a cable without an insulating covering and an insulating covering fixing portion connected to the conductor fixing portion and used to clamp and fix a part of the cable with the insulating covering.

27. An electrical connector assembly, comprising:

a first connector and a second connector mated with the first connector, the first connector including a first insulating housing and a plurality of conductive terminals provided in the first insulating housing, the second connector including a second insulating housing and a plurality of conductive terminals provided in the second insulating housing;

each conductive terminal of the first connector and the second connector having:

a base unit further including a bottom plate extending along a front-rear direction and two side plates integrally extending upwardly respectively from a left side and a right side of the bottom plate;

two elastic contact pieces arranged adjacent to each other, each elastic contact piece having a connecting portion bent upwardly from a front end of the bottom plate, an arm portion extending rearwardly from the connecting portion, positioned above and spaced apart from the bottom plate, and a first contact portion positioned at a rear end of the arm portion;

a tail unit connected to a rear end of the bottom plate;

two contact plates respectively bent from the two side plates toward each other, each contact plate having a second contact portion and a guide portion positioned in front of the second contact portion, the second contact portion being positioned above the arm portion of the corresponding the elastic contact piece, the guide portion extending forwardly and downwardly and positioned above the connecting portion, the two first contact portions of the two elastic contact pieces extend upwardly respectively from two rear ends of the two contact plates and positioned respectively above the two second contact portions; and each conductive terminal of the first connector is used to respectively mate with a conductive terminal of the second connector, a wherein the two first contact portions of one conductive terminal contacts the two second contact portions of the other conductive terminal and the two first contact portions of the other conductive terminal respectively contacting the two second contact portions of the one conductive terminal.

28. The electrical connector assembly according to claim 27, wherein the two side plates of the base unit of each electrical terminal respectively partially covers two side gaps defined between two side edges of the bottom plate and two side edges of the two arm portions of the two elastic contact pieces.

29. The electrical connector assembly according to claim 28, wherein each elastic contact piece of each conductive terminal further includes an extending portion, the extending portion bent from a rear end of the first contact portion and extending rearwardly and obliquely, and a distal end of the extending portion is positioned between the two side plates.

30. The electrical connector assembly according to claim 29, wherein each conductive terminal further includes two protect plates respectively bent from two upper edges of the two side plates and extend toward each other, the two protect plates are respectively positioned adjacent the two extending portions of the two elastic contact pieces.

31. The electrical connector assembly according to claim 27, wherein the first insulating housing has a first mating portion, a first mounting portion integrally connected with the first mating portion and a plurality of terminal grooves each penetrating the first mating portion and the first mounting portion;

the second insulating housing has a second mating portion, a second mounting portion integrally connected with the second mating portion and a plurality of terminal grooves each penetrating the second mating portion and the second mounting portion;

the second mating portion is used to mate with the first mating portion;

the plurality of terminal grooves of the first insulating housing respectively receive the plurality of conductive terminals of the first connector;

the plurality of terminal grooves of the second insulating housing respectively receive the plurality of conductive terminals of the second connector.

32. The electrical connector assembly according to claim 31, wherein the bottom plate of each conductive terminal has a plate portion and two wing portions respectively extending from two sides of a front end of the plate portion, the two wing portions respectively positioned in front of the two side plates; and wherein each terminal groove is provided with two side groove portions respectively configured to receive the wing portions of the corresponding conductive terminal therein.

33. The electrical connector assembly according to claim 31, wherein the tail unit of each conductive terminal includes a positioning portion connected to the plate portion, a conductor fixing portion connected to the positioning portion and used to clamp and fix a part of a conductor of a cable without an insulating covering and an insulating covering fixing portion connected to the conductor fixing portion and used to clamp and fix a part of the cable with the insulating covering.

34. The electrical connector assembly according to claim 33, wherein each terminal groove further includes an elastic finger and a stopping block positioned in front and spaced apart from the elastic finger, a step portion is formed on the elastic finger, the stopping block is formed with a stopping protrusion extending toward the rear;

a first side of the positioning portion of each conductive terminal abuts against a rear surface of the stopping block, and a second side of the positioning portion abuts against the step portion of the elastic finger portion and the positioning portion is sheathed onto the stopping block.

35. The electrical connector assembly according to claim 34, wherein the first connector further includes a first terminal holding member, the second connector further includes a second terminal holding member;

the first terminal holding member engages the first mounting portion and has a first positioning piece configured to enter the respective terminal groove of the first insulating housing, each first positioning piece engages the second side of the positioning portion of the corresponding conductive terminal of the first connector;

the second terminal holding member engages the second mounting portion and has a second positioning piece configured to enter the terminal groove of the second insulating housing, each second positioning piece engages the second side of the positioning portion of the corresponding conductive terminal of the second connector.

36. A conductive terminal, comprising:

a base unit, a contacting unit, a connecting piece and a tail unit, the connecting piece connecting the base unit and the contacting unit, the base unit includes a plate portion extending along a front-rear direction, the contacting unit facing the plate portion and being spaced apart from the plate portion and having a plate-shaped contacting portion and an elastic contacting portion positioned behind the plate-shaped contacting portion, the tail unit being connected to a rear end of the plate portion, wherein the contacting unit includes a plate body parallel to and spaced apart from the plate portion, the elastic contacting portion is formed from the plate body and a notch is formed along the separation location of the elastic contacting portion of the plate body, and wherein the plate body further includes an outer surface opposite to the plate portion, the elastic contacting portion having an elastic arm connected to the plate-shaped contacting portion and further including an extending section, the elastic arm extends along a front-rear direction and a distal end of the elastic arm projects from the outer surface of the plate body, the extending section is bent from the distal end of the elastic arm and extends rearwardly and obliquely, and a distal end of the extending section enters into the notch.

37. The conductive terminal according to claim 36, wherein the elastic arm includes a downward extending section which extends rearwardly and obliquely toward the plate portion through the notch and an upward extending section which extends rearwardly and obliquely from the downward extending section away from the plate portion, a connected location between the downward extending section and the upward extending section is positioned between the notch and the plate portion.

38. A conductive terminal, comprising:

a base unit, a contacting unit, a connecting piece and a tail unit, the connecting piece connecting the base unit and the contacting unit, the base unit includes a plate portion extending along a front-rear direction, the contacting unit facing the plate portion and being spaced apart from the plate portion and having a plate-shaped contacting portion and an elastic contacting portion positioned behind the plate-shaped contacting portion, the tail unit being connected to a rear end of the plate portion, wherein the contacting unit includes a plate body parallel to and spaced apart from the plate portion, the elastic contacting portion is formed from the plate body and a notch is formed along the separation location of the elastic contacting portion of the plate body, and wherein the connecting piece connects a front end of the plate portion and a front end of the plate body, the base unit further includes two side plate portions respectively bent from two sides of the plate portion, the two side plate portions respectively partially cover two side gaps defined between two side edges of the plate portion and two side edges of the plate body.

39. The conductive terminal according to claim 38, wherein the base unit further includes two wing portions extending respectively from two sides of the front end of the plate portion, the two wing portions are respectively positioned between the two side plate portions and the connecting piece.

* * * * *